US011078746B2

(12) United States Patent
Brown et al.

(10) Patent No.: US 11,078,746 B2
(45) Date of Patent: Aug. 3, 2021

(54) EXPANDING AND COLLAPSING APPARATUS AND METHODS OF USE

(71) Applicants: PEAK WELL SYSTEMS PTY LTD, Bayswater (AU); PEAK WELL SYSTEMS LIMITED, Aberdeenshire (GB)

(72) Inventors: Gareth Brown, Aberdeenshire (GB); Robin McGowan, Dubai (AE)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/348,285

(22) PCT Filed: Nov. 9, 2017

(86) PCT No.: PCT/GB2017/053381
§ 371 (c)(1),
(2) Date: May 8, 2019

(87) PCT Pub. No.: WO2018/087553
PCT Pub. Date: May 17, 2018

(65) Prior Publication Data

US 2019/0323316 A1 Oct. 24, 2019

(30) Foreign Application Priority Data

Nov. 9, 2016 (GB) ..... 1618952

(51) Int. Cl.
*E21B 33/128* (2006.01)
*E21B 33/12* (2006.01)

(52) U.S. Cl.
CPC ..... *E21B 33/128* (2013.01); *E21B 33/1216* (2013.01); *E21B 2200/01* (2020.05)

(58) Field of Classification Search
CPC ..... E21B 33/128; E21B 33/1216
See application file for complete search history.

(56) References Cited

U.S. PATENT DOCUMENTS 2,701,615 A 2/1955 Riordan, Jr.
3,572,627 A 3/1971 Jones
(Continued)

FOREIGN PATENT DOCUMENTS

AU 2003252894 A1 4/2004
CN 105705726 A 6/2016
(Continued)

OTHER PUBLICATIONS

Examination Report issued in the related GB application 1618952.4, dated Jan. 7, 2020 (4 pages).
(Continued)

*Primary Examiner* — Kristyn A Hall
*Assistant Examiner* — Dany E Akakpo
(74) *Attorney, Agent, or Firm* — Ashley E. Brown

(57) ABSTRACT

The invention provides an expanding and collapsing apparatus and methods of use. The apparatus comprises a plurality of elements (52) assembled together to form a ring structure (54) around a longitudinal axis. The ring structure is operable to be moved between an expanded condition and a collapsed condition by movement of the plurality of elements. At least one set of structural elements (56) each having a first end and a second end are operable to move between the expanded condition and the collapsed condition by movement of the first end in an axial direction, and by movement of the second end in a radial dimension. At least one set of elements is operable to be moved by sliding with respect to one another in a direction tangential to a circle concentric with the ring structure. In another aspect, the plurality of elements (82) comprises at least one set of
(Continued)

structural elements (86) extending longitudinally on the apparatus and operable to slide with respect to one another, wherein the sliding movement in a selected plane perpendicular to the longitudinal axis is tangential to a circle in the selected plane and concentric with the longitudinal axis. Applications of the invention include oilfield devices, including anti-extrusion rings, plugs, packers, locks, patching tools, connection systems, and variable diameter tools run in a wellbore.

19 Claims, 21 Drawing Sheets

(56) References Cited

U.S. PATENT DOCUMENTS

| | | | | |
|---|---|---|---|---|
| 3,915,424 | A | 10/1975 | LeRouax | |
| 4,098,516 | A | 7/1978 | Murman | |
| 4,544,165 | A | 10/1985 | Coone | |
| 4,576,042 | A | 3/1986 | Johnson | |
| 4,923,007 | A | 5/1990 | Sanford et al. | |
| 7,290,603 | B2 | 11/2007 | Hiorth et al. | |
| 7,921,921 | B2 | 4/2011 | Bishop et al. | |
| 8,083,001 | B2 | 12/2011 | Conner et al. | |
| 8,167,033 | B2 | 5/2012 | White | |
| 2003/0047880 | A1 | 3/2003 | Ross | |
| 2004/0194969 | A1 | 10/2004 | Hiorth et al. | |
| 2006/0005963 | A1 | 1/2006 | Hiorth et al. | |
| 2011/0048744 | A1 | 3/2011 | Conner et al. | |
| 2011/0073328 | A1 | 3/2011 | Clemens et al. | |
| 2011/0265986 | A1 | 11/2011 | Porter et al. | |
| 2012/0227987 | A1 | 9/2012 | Castriotta et al. | |
| 2013/0161006 | A1 | 6/2013 | Robisson | |
| 2013/0206410 | A1 | 8/2013 | Guerrero | |
| 2013/0319654 | A1 | 12/2013 | Hiorth et al. | |
| 2013/0333875 | A1* | 12/2013 | Hiorth | E21B 33/128 166/179 |
| 2015/0152704 | A1 | 6/2015 | Tunget | |
| 2015/0275618 | A1 | 10/2015 | Clemens et al. | |

FOREIGN PATENT DOCUMENTS

| | | | |
|---|---|---|---|
| EP | 1197632 | A2 | 4/2002 |
| EP | 2242897 | A1 | 10/2010 |
| GB | 2432600 | A | 5/2007 |
| GB | 2545817 | A | 6/2017 |
| GB | 2546005 | A | 7/2017 |
| GB | 2546007 | A | 7/2017 |
| GB | 2549163 | A | 10/2017 |
| NO | 321083 | B1 | 3/2006 |
| WO | 2006103434 | A1 | 10/2006 |
| WO | 2008062186 | A1 | 5/2008 |
| WO | 2009098465 | A1 | 8/2009 |
| WO | 2012079913 | A2 | 6/2012 |
| WO | 2012079914 | A2 | 6/2012 |
| WO | 2014108692 | A2 | 7/2014 |

OTHER PUBLICATIONS

International Preliminary Report on Patentability issued in the related PCT application PCT/GB2017/053381, dated May 14, 2019 (8 pages).

International Search Report and Written Opinion issued in the related PCT application PCT/GB2017/053381, dated Mar. 15, 2018 (14 pages).

Combined Search and Examination Report issued in the related GB application 1618952.4, dated May 2, 2017 (9 pages).

Communication Pursuant to Article 94(3) issued in EP Application 17818203.6, dated Oct. 6, 2020 (7 Pages).

Search Report issued in the related GB application 1618952.4, dated Dec. 1, 2020 (7 pages).

Examination Report issued in the related GB application 1618952.4, dated Dec. 1, 2020 (7 pages).

1st Chinese Office Action issued in the related Chinese Patent Application No. 2017800774837 dated Mar. 2, 2021, 17 pages with English translation.

* cited by examiner

EXPANDING AND COLLAPSING APPARATUS AND METHODS OF USE

CROSS-REFERENCE TO RELATED APPLICATIONS

This application is a 371 national stage application of PCT/GB2017/053381, filed Nov. 9, 2017, which claims the benefit of Great Britain Application No. 1618952.4, filed Nov. 9, 2016, the disclosures of which are incorporated herein by reference.

FIELD OF THE INVENTION

The present invention relates to an expanding and collapsing apparatus and methods of use, and in particular aspects, to an expanding apparatus in the form of a ring, operable to move between a collapsed condition and an expanded condition. The invention also relates to tools and devices incorporating the expansion apparatus and methods of use. Preferred embodiments of the invention relate to oilfield apparatus (including downhole apparatus and wellhead apparatus) incorporating the apparatus and methods of use.

BACKGROUND TO THE INVENTION

In many fields of mechanical engineering, and in the field of hydrocarbon exploration and production in particular, it is known to provide expansion mechanisms for the physical interaction of tubular components. Expansion mechanisms may expand outwardly to engage an external surface, or may collapse inwardly to engage an internal surface.

Applications are many and varied, but in hydrocarbon exploration and production include the actuation and setting of flow barriers and seal elements such as plugs and packers, anchoring and positioning tools such as wellbore anchors, casing and liner hangers, and locking mechanisms for setting equipment downhole. Other applications include providing anti-extrusion, mechanical support or back up for elements such as elastomers or inflatable bladders.

A typical anti-extrusion ring is positioned between a packer or seal element and its actuating slip members, and is formed from a split or segmented metallic ring. During deployment of the packer or seal element, the segments move to a radially expanded condition. During expansion and at the radially expanded condition, spaces are formed between the segments, as they are required to occupy a larger annular volume. These spaces create extrusion gaps, which may result in failure of the packer or seal under working conditions.

Various configurations have been proposed to minimise the effect of spaces between anti-extrusion segments, including providing multi-layered rings, such that extrusion gaps are blocked by an offset arrangement of segments. For example, U.S. Pat. No. 6,598,672 describes an anti-extrusion ring for a packer assembly which has first and second ring portions which are circumferentially offset to create gaps in circumferentially offset locations.

U.S. Pat. No. 2,701,615 discloses a well packer comprising an arrangement of crowned spring metal elements which are expanded by relative movement.

Other proposals, for example those disclosed in U.S. Pat. Nos. 3,572,627, 7,921,921, US 2013/0319654, U.S. Pat. Nos. 7,290,603 and 8,167,033 include arrangements of circumferentially lapped segments. U.S. Pat. No. 3,915,424 describes a similar arrangement in a drilling BOP configuration, in which overlapping anti-extrusion members are actuated by a radial force to move radially and circumferentially to a collapsed position which supports annular sealing elements. Such arrangements avoid introducing extrusion gaps during expansion, but create a ring with uneven or stepped faces or flanks. These configurations do not provide an unbroken support wall for a sealing element, are spatially inefficient, and may be difficult to reliably move back to their collapsed configurations.

U.S. Pat. No. 8,083,001 proposes an alternative configuration in which two sets of wedge shaped segments are brought together by sliding axially with respect to one another to create an expanded gauge ring.

Applications of existing expanding and collapsing apparatus are limited by the expansion ratios that can be achieved.

In anchoring, positioning, setting, locking and connection applications, radially expanding and collapsing structures are typically circumferentially distributed at discrete locations when at their increased outer diameter. This reduces the surface area available to contact an auxiliary engagement surface, and therefore limits the maximum force and pressure rating for a given size of device.

SUMMARY OF THE INVENTION

It is amongst the claims and objects of the invention to provide an expanding and collapsing apparatus and methods of use which obviate or mitigate disadvantages of previously proposed expanding and collapsing apparatus.

It is amongst the aims and objects of the invention to provide an oilfield apparatus, including but not limited to a downhole apparatus, a wellhead apparatus, or a drilling apparatus, incorporating an expanding and collapsing apparatus, which obviates or mitigates disadvantages of prior art oilfield apparatus.

Further aims and objects of the invention will be apparent from reading the following description.

In the context of this description, the terms "ring" and "ring structure" are used to designate an arrangement of one or more components or elements joined to itself to surround an axis, but is not limited to arrangements which are rotationally symmetric or symmetric about a plane perpendicular to the axis.

According to a first aspect of the invention, there is provided an apparatus comprising: a plurality of elements assembled together to form a ring structure around a longitudinal axis;

wherein the ring structure is operable to be moved between an expanded condition and a collapsed condition by movement of the plurality of elements;

wherein the plurality of elements comprises at least one set of structural elements each having a first end and a second end, wherein the structural elements are operable to move between the expanded condition and the collapsed condition by movement of the first end in an axial direction, and by movement of the second end in at least a radial dimension;

and wherein the plurality of elements comprises at least one set of elements operable to be moved between the expanded and collapsed conditions by sliding with respect to one another in a direction tangential to a circle concentric with the ring structure.

The second end may be operable to move in a radial direction and an axial direction of the apparatus. The structural elements may be operable to move in a circumferential direction of the apparatus.

Preferably, the structural elements extend longitudinally on the apparatus. An outermost dimension of the second end of a structural element may be disposed at a radial distance from the longitudinal axis which is greater than a radial distance of an outermost dimension of the first end when the apparatus is in the expanded condition and/or a partially expanded condition. Alternatively, or in addition, an outermost dimension of the second end of a structural element may be disposed at a radial distance from the longitudinal axis which is greater than a radial distance of an outermost dimension of the first end when the apparatus is in the collapsed condition.

The apparatus may comprise a retaining ring which connects to the first ends of the structural elements. The retaining ring is preferably moveable axially on the apparatus, and may be operable to move the first end of the structural elements axially on the apparatus.

The set of structural elements may together form a substantially conical structure in an expanded condition (including a partially, fully, or substantially fully expanded condition). Alternatively, or in addition, the set of structural elements may together form a substantially conical structure in the collapsed condition and/or a partially expanded condition. The substantially conical structure may be a truncated conical structure, and/or may define a partially convex outer profile in at least its collapsed condition.

In an embodiment, the plurality of elements comprises at least one set of ring elements, distinct from the set of structural elements, operable to be moved between the expanded and collapsed conditions by sliding with respect to one another in a direction tangential to a circle concentric with the ring structure. The set of structural elements may be directly or indirectly connected to the set of ring elements, and they may together be operable to be moved between the expanded condition and the collapsed condition.

In an alternative embodiment, the structural elements may comprise structural ring elements, operable to be moved between the expanded and collapsed conditions by sliding with respect to one another in a direction tangential to a circle concentric with the ring structure.

The ring elements and/or structural ring elements may describe an angle at an outer surface of the ring structure ($\theta_1$) of 45 degrees or less. Such a configuration corresponds to eight or more ring elements assembled together to form the ring structure.

Preferably, the described angle is 30 degrees or less, corresponding to twelve or more ring elements assembled together to form the ring. More preferably, the described angle is in the range of 10 degrees to 20 degrees, corresponding to eighteen to thirty-six elements assembled together to form the ring. In a particular preferred embodiment, described angle is 15 degrees, corresponding to twenty-four ring elements assembled together to form the ring structures.

The ring elements may comprise first and second contact surfaces which may be oriented on first and second planes. The first and second orientation planes may intersect or meet (i.e. be a tangent to) an inner surface of the ring structure formed by the segments at first and second lines. The orientation planes may be tangential to the inner surface of the ring structure in its expanded condition. Alternatively, the inner surface of the ring structure may have a truncated (increased) inner diameter, and the orientation planes may be tangential to a circle with smaller diameter than the inner surface of the ring structure. The orientation planes may therefore intersect the inner surface of the ring structure in its expanded condition, at an angle (which may be defined as $\theta_2$ between a radial plane from the centre of the ring structure and the intersection or tangent point.

Where the structural elements extend longitudinally on the apparatus, they may be operable to slide with respect to one another, with the sliding movement in a selected plane perpendicular to the longitudinal axis being tangential to a circle in the selected plane and concentric with the longitudinal axis. In an embodiment, the structural elements extend longitudinally on the apparatus and are operable to slide with respect to one another, with the sliding movement in any selected plane along the length of the structural element and perpendicular to the longitudinal axis being tangential to a circle in the selected plane and concentric with the longitudinal axis.

In a further alternative embodiment, the apparatus may comprise one or more sets of structural ring elements, operable to be moved between the expanded and collapsed conditions by sliding with respect to one another in a direction tangential to a circle concentric with the ring structure, and one or more sets of ring elements, distinct from the one or more sets of structural ring elements.

The structural element may be pivotally connected to a ring element at its second end. Preferably, the structural element is connected to a ring element by a connection configured to enable the transfer of a tensile force between the structural element and a ring element. This enables a tension to be pulled between the structural element and a ring element (or vice versa), which may assist with retraction of the apparatus from an expanded or partially expanded condition. The structural element may for example be connected to a ring element by a ball and socket or knuckle and socket connection. Where the apparatus comprises a retaining ring, the structural element may be connected to the retaining ring at its first end, by a connection which enables the transfer of a tensile force between the structural element and the retaining ring, for example by a ball and socket or knuckle and socket connection. Therefore a tension may be pulled between the structural element and the retaining ring (or vice versa), which may assist with retraction of the apparatus from an expanded or partially expanded condition.

Where the set of structural elements together form a substantially conical structure, the substantially conical structure may comprise openings in the conical surface between the structural elements. In such an embodiment, a structural element may comprise a strut or spoke, and/or the apparatus may comprise a plurality of struts or spokes circumferentially distributed about the longitudinal axis.

In an embodiment of the invention, the substantially conical structure may comprise a substantially continuous conical surface in the expanded condition, or a partially expanded or substantially expanded condition. The substantially conical structure may comprise a hollow cone. The substantially conical structure may comprise a substantially or fully uniform wall thickness. Alternatively, or in addition, the substantially conical structure may comprise a tapering wall thickness. The substantially conical structure may comprise a cylindrical portion extending from its flared end.

The hollow cone may be formed from the set of structural ring elements in the expanded or a substantially expanded condition. Each of the structural ring elements may be a segment of a cone. The structural ring elements may extend longitudinally on the apparatus and may be operable to slide with respect to one another, with the sliding movement in any selected plane along the length of the structural element and perpendicular to the longitudinal axis being tangential to a circle in the selected plane and concentric with the longitudinal axis.

The structural ring element may be pivotally connected to a ring element at its second end. The structural ring element may be pivotally connected to a ring element by a ball and socket or knuckle and socket connection. Where the apparatus comprises a retaining ring, the structural ring element may be pivotally connected to the retaining ring at its first end, by a connection which enables the transfer of a tensile force between the structural element and the retaining ring, for example by a ball and socket or knuckle and socket connection. Therefore a tension may be pulled between the structural element and the retaining ring (or vice versa), which may assist with retraction of the apparatus from an expanded or partially expanded condition.

The apparatus may comprise a first set of structural elements, a second set of structural elements, and a set of ring elements distinct from the structural elements. The first set of structural elements may be connected to the set of ring elements at a first axial side of the set of ring elements, and the second set of structural elements may be connected to the set of ring elements at a second axial side of the set of ring elements. The first and/or second set of structural elements may comprise structural ring elements, which may be segments of a cone.

Where the structural ring elements are segments of a cone, they may describe an angle at an outer surface of the cone ($\theta_1$) of 45 degrees or less. Such a configuration corresponds to eight or more ring elements assembled together to form the ring structure. Preferably, the described angle is 15 degrees or less, corresponding to twelve or more structural ring elements assembled together to form the structural ring. More preferably, the described angle is in the range of 10 degrees to 20 degrees, corresponding to eighteen to thirty-six structural elements assembled together to form the structural ring. In a particular preferred embodiment, described angle is 15 degrees, corresponding to twenty-four ring elements assembled together to form the structural ring.

The ring elements may comprise first and second contact surfaces which may be oriented on first and second planes. The first and second orientation planes may intersect or meet (i.e. be a tangent to) an inner surface of the ring structure formed by the segments at first and second lines. The orientation planes may be tangential to the inner surface of the ring structure in its expanded condition. The orientation planes of the first and second contact surfaces may intersect on a radial plane P which bisects the radial planes at the tangent points (i.e. is at an angle of $\theta_1/2$ to both). This intersection plane P may define the expanding and collapsing path of the cone segment.

The collapsed condition may be a first condition of the apparatus, and the expanded condition may be a second condition of the apparatus. Thus the apparatus may be normally collapsed, and may be actuated to be expanded. Alternatively, the expanded condition may be a first condition of the apparatus, and the collapsed condition may be a second condition of the apparatus. Thus the apparatus may be normally expanded, and may be actuated to be collapsed.

The ring structure may comprise one or more ring surfaces, which may be presented to an auxiliary surface, for example the surface of a tubular, when actuated to an expanded condition or a collapsed condition. The one or more ring surfaces may include a ring surface which is parallel to the longitudinal axis of the apparatus. The ring surface may be an outer ring surface, and may be a substantially cylindrical surface. The ring surface may be arranged to contact or otherwise interact with an inner surface of a tubular or bore.

Alternatively, the ring surface may be an inner surface of the ring structure, and may be a substantially cylindrical surface. The ring surface may be arranged to contact or otherwise interact with an outer surface of a tubular or cylinder.

The ring surface may be substantially smooth. Alternatively, the ring surface may be profiled, and/or may be provided with one or more functional formations thereon, for interacting with an auxiliary surface.

In the collapsed condition, the ring elements may be arranged generally at collapsed radial positions, and may define a collapsed outer diameter and inner diameter of the ring structure.

In the expanded condition, the ring elements may be arranged generally at expanded radial positions, and may define an expanded outer diameter and inner diameter of the ring structure. The ring surface may be located at or on the expanded outer diameter of the ring structure, or may be located at or on the collapsed inner diameter of the ring structure.

In the collapsed condition, the elements may occupy a collapsed annular volume, and in the expanded condition the elements may occupy an expanded annular volume. The collapsed annular volume and the expanded annular volume may be discrete and separated volumes, or the volumes may partially overlap.

The ring elements may be configured to move between their expanded and collapsed radial positions in a path which is tangential to a circle described around and concentric with the longitudinal axis.

Preferably, each ring element of the ring structure comprises a first contact surface and second contact surface respectively in abutment with first and second adjacent elements. The ring elements may be configured to slide relative to one another along their respective contact surfaces.

The first contact surface and/or the second contact surface may be oriented tangentially to a circle described around and concentric with the longitudinal axis. The first contact surface and the second contact surface are preferably non-parallel. The first contact surface and the second contact surface may converge towards one another in a direction towards an inner surface of the ring structure (and may therefore diverge away from one another in a direction away from an inner surface of the ring structure).

At least some of the ring elements are preferably provided with interlocking profiles for interlocking with an adjacent element. Preferably the interlocking profiles are formed in the first and/or second contact surfaces. Preferably, a ring element is configured to interlock with a contact surface of an adjacent element. Such interlocking may prevent or restrict separation of assembled adjacent elements in a circumferential and/or radial direction of the ring structure, while enabling relative sliding movement of adjacent elements.

Preferably, at least some of, and more preferably all of, the ring elements assembled to form a ring are identical to one another, and each comprises an interlocking profile which is configured to interlock with a corresponding interlocking profile on another ring element. The interlocking profiles may comprise at least one recess such as groove, and at least one protrusion, such as a tongue or a pin, configured to be received in the groove. The interlocking profiles may comprise at least one dovetail recess and dovetail protrusion.

The first and second contact surfaces of a ring element may be oriented on first and second planes, which may intersect an inner surface of the ring at first and second intersection lines, such that a sector of an imaginary cylinder is defined between the longitudinal axis and the intersection lines. The central angle of the sector may be 45 degrees or less. Such a configuration corresponds to eight or more ring elements assembled together to form the ring structure.

Preferably, the central angle of the sector is 30 degrees or less, corresponding to twelve or more ring elements assembled together to form the ring. More preferably, the central angle of the sector is in the range of 10 degrees to 20 degrees, corresponding to eighteen to thirty-six ring elements assembled together to form the ring. In a particular preferred embodiment, the central angle of the sector is 15 degrees, corresponding to twenty-four ring elements assembled together to form the ring structure.

Each ring element may comprise one, preferably two, structural elements connected to the ring structure. The structural elements may comprise structural ring elements, and may be defined by the same central angles as the ring elements.

Preferably, an angle described between the first contact and second contact surfaces corresponds to the central angle of the sector. Preferably therefore, an angle described between the first contact and second contact surfaces is in the range of 10 degrees to 20 degrees, and in a particular preferred embodiment, the angle described between the first contact and second contact surfaces is 15 degrees, corresponding to twenty-four elements assembled together to form the ring structure.

In a preferred embodiment, the apparatus comprises a support surface for the ring structure. The support surface may be the outer surface of a mandrel or tubular. The support surface may support the ring structure in a collapsed condition of the apparatus.

The support surface may be the inner surface of a mandrel or tubular. The support surface may support the ring structure in an expanded condition of the apparatus.

In some embodiments, the apparatus is operated in its expanded condition, and in other embodiments, the apparatus is operated in its collapsed condition. Preferably, at least some of the elements forming the ring structure are mutually supportive in an operating condition of the apparatus. Where the operating condition of the apparatus its expanded condition (i.e. when the apparatus is operated in its expanded condition), the apparatus may comprise a substantially solid cylindrical ring structure in its expanded condition, and the ring elements may be fully mutually supported.

In an embodiment, the substantially solid cylindrical ring structure of the apparatus may be supported by one or more substantially conical structures formed from the structural elements. The structural elements may be fully mutually supported.

In an embodiment, the apparatus may comprise one or more substantially conical structures in its expanded condition, and the structural elements may be fully mutually supported.

Where the operating condition of the apparatus its collapsed condition (i.e. when the apparatus is operated in its collapsed condition), the ring structure is preferably a substantially solid ring structure in its collapsed condition, and the ring elements may be fully mutually supported.

The apparatus may comprise a formation configured to impart a radial expanding or collapsing force component to the structural elements of a ring structure from an axial actuation force. The apparatus may comprise a pair of formations configured to impart a radial expanding or collapsing force component to the structural elements of a ring structure from an axial actuation force. The formation (or formations) may comprise a wedge or wedge profile, and may comprise a cone wedge or wedge profile.

The apparatus may comprise a biasing means, which may be configured to bias the ring structure to one of its expanded or collapsed conditions. The biasing means may comprise a circumferential spring, a garter spring, or a spiral retaining ring. The biasing means may be arranged around an outer surface of a ring structure, to bias it towards a collapsed condition, or may be arranged around an inner surface of a ring structure, to bias it towards an expanded condition. One or more elements may comprise a formation such as a groove for receiving the biasing means. Preferably, grooves in the elements combine to form a circumferential groove in the ring structure. Multiple biasing means may be provided on the ring structure.

According to a second aspect of the invention, there is provided an apparatus comprising:

a plurality of elements assembled together to form a ring structure around a longitudinal axis;

wherein the ring structure is operable to be moved between an expanded condition and a collapsed condition by movement of the plurality of elements;

wherein the plurality of elements comprises at least one set of structural elements extending longitudinally on the apparatus and operable to slide with respect to one another, wherein the sliding movement in a selected plane perpendicular to the longitudinal axis is tangential to a circle in the selected plane and concentric with the longitudinal axis.

In an embodiment, the structural elements extend longitudinally on the apparatus and are operable to slide with respect to one another, with the sliding movement in any selected plane along the length of the structural element and perpendicular to the longitudinal axis being tangential to a circle in the selected plane and concentric with the longitudinal axis.

The structural elements may each have a first end and a second end, wherein the structural elements are operable to move between the expanded condition and the collapsed condition by movement of the first end in an axial direction, and by movement of the second end in at least a radial dimension;

and wherein the plurality of elements comprises at least one set of elements operable to be moved between the expanded and collapsed conditions by sliding with respect to one another in a direction tangential to a circle concentric with the ring structure.

Embodiments of the second aspect of the invention may include one or more features of the first aspect of the invention or its embodiments, or vice versa.

According to a third aspect of the invention, there is provided an expanding and collapsing ring apparatus comprising:

a plurality of elements assembled together to form a ring structure around a longitudinal axis;

wherein the ring structure is operable to be moved between an expanded condition and a collapsed condition;

wherein in the expanded condition, the plurality of elements combine to form a conical structure having a substantially smooth conical outer surface.

The substantially smooth conical outer surface may be substantially unbroken. Preferably, the ring structure comprises a pair of conical structures having substantially smooth conical outer surfaces. Thus one or more flanks or faces of the ring structure, which are the surfaces presented in the longitudinal direction, may have smooth surfaces.

The apparatus may also comprise a solid ring structure having a substantially smooth circular profile in a plane perpendicular to the longitudinal axis.

The plurality of elements may comprise at least one set of structural elements.

The plurality of elements may comprise at least one set of elements operable to be moved between the expanded and collapsed conditions by sliding with respect to one another in a direction tangential to a circle concentric with the ring structure.

Where the structural elements extend longitudinally on the apparatus, they may be operable to slide with respect to one another, with the sliding movement in a selected plane perpendicular to the longitudinal axis being tangential to a circle in the selected plane and concentric with the longitudinal axis. In an embodiment, the structural elements extend longitudinally on the apparatus and are operable to slide with respect to one another, with the sliding movement in any selected plane along the length of the structural element and perpendicular to the longitudinal axis being tangential to a circle in the selected plane and concentric with the longitudinal axis.

The structural elements may each have a first end and a second end, wherein the structural elements are operable to move between the expanded condition and the collapsed condition by movement of the first end in an axial direction, and by movement of the second end in at least a radial dimension;

and wherein the plurality of elements comprises at least one set of elements operable to be moved between the expanded and collapsed conditions by sliding with respect to one another in a direction tangential to a circle concentric with the ring structure.

Embodiments of the third aspect of the invention may include one or more features of the first or second aspects of the invention or their embodiments, or vice versa.

According to a fourth aspect of the invention, there is provided an oilfield apparatus comprising:

a plurality of elements assembled together to form a first ring structure around a longitudinal axis;

a plurality of elements assembled together to form a second ring structure around a longitudinal axis;

wherein the first and second ring structures are operable to be moved between expanded conditions and collapsed conditions;

wherein in their expanded conditions, the plurality of elements of the first and second ring structures combine to form first and second conical structures;

and wherein at least one of the first and second ring structures provides mechanical support to the other of the first and second ring structures in their expanded conditions.

Embodiments of the fourth aspect of the invention may include one or more features of the first to third aspects of the invention or their embodiments, or vice versa.

According to a fifth aspect of the invention, there is provided a fluid barrier apparatus for a borehole or conduit, the fluid barrier apparatus comprising an expanding and collapsing apparatus according to any preceding aspect of the invention.

The fluid barrier apparatus may comprise a sealing apparatus for a borehole or conduit, and may be configured to hold a pressure differential across the sealing apparatus.

Embodiments of the fifth aspect of the invention may include one or more features of the first to fourth aspects of the invention or their embodiments, or vice versa.

According to a sixth aspect of the invention, there is provided a sealing assembly for a borehole or conduit, the sealing assembly comprising:

at least one expanding and collapsing apparatus according to any preceding aspect of the invention and a sealing element;

wherein the at least one expanding and collapsing apparatus is arranged to provide mechanical support to the sealing element in its expanded condition.

The sealing apparatus may comprise a first expanding and collapsing apparatus according to any preceding aspect of the invention and a second expanding and collapsing apparatus according to any preceding aspect of the invention. The sealing element may be disposed between the first and second expanding and collapsing apparatus, and may be mechanically supported by the first and second expanding and collapsing apparatus in their expanded conditions.

Embodiments of the sixth aspect of the invention may include one or more features of the first to fifth aspects of the invention or their embodiments, or vice versa.

According to a further aspect of the invention, there is provided an oilfield tool comprising the apparatus of any preceding aspect of the invention.

The oilfield tool may be a downhole tool. Alternatively, the oilfield tool may comprise a wellhead tool.

The downhole tool may comprise a downhole tool selected from the group consisting of a plug, a packer, an anchor, a tubing hanger, or a downhole locking tool.

The plug may be a bridge plug, and may be a retrievable bridge plug. Alternatively, the plug may be a permanent plug.

According to a further aspect of the invention, there is provided variable diameter downhole tool, the tool comprising an apparatus according to a previous aspect of the invention.

The downhole tool may be selected from the group consisting of a wellbore centraliser, a wellbore broach tool, and a wellbore drift tool.

According to a further aspect of the invention, there is provided a connector system comprising a first connector and a second connector, wherein one of the first and second connectors comprises the apparatus of any of the preceding aspects of the invention.

According to a further aspect of the invention, there is provided a patch apparatus for a fluid conduit or tubular, the patch apparatus comprising the apparatus of any of the preceding aspects of the invention.

According to a further aspect of the invention there is provided a method of expanding or collapsing an expanding and collapsing apparatus, the method comprising:

providing a plurality of elements assembled together to form a ring structure around a longitudinal axis, wherein the plurality of elements comprises at least one set of structural elements each having a first end and a second end, moving the first ends of the structural segments in an axial direction, and moving the second ends of the structural segments in at least a radial dimension;

and moving at least one set of elements between the expanded and collapsed conditions by sliding them with respect to one another in a direction tangential to a circle concentric with the ring structure.

According to a further aspect of the invention there is provided a method of expanding or collapsing an expanding and collapsing apparatus, the method comprising:

providing a plurality of elements assembled together to form a first ring structure around a longitudinal axis; and a plurality of elements assembled together to form a second ring structure around a longitudinal axis;

moving the first and second ring structures between expanded conditions and collapsed conditions;

wherein in their expanded conditions, the plurality of elements of the first and second ring structures combine to form first and second conical structures;

and wherein at least one of the first and second ring structures provides mechanical support to the other of the first and second ring structures in their expanded conditions.

According to a further aspect of the invention there is provided a method of forming a fluid barrier or seal in a bore comprising the method or apparatus of a previous aspect of the invention. The bore may be a wellbore, and may be a cased or lined wellbore.

Embodiments of the further aspects of the invention may include one or more features of any preceding aspect of the invention or its embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
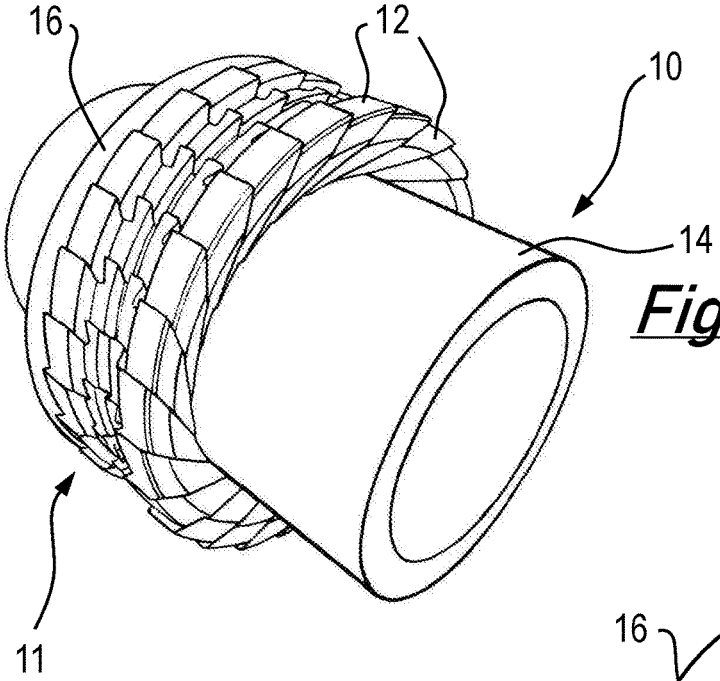
FIGS. 1A to 1D are respectively perspective, first end, part sectional and second end views of an apparatus useful for understanding the invention, shown in a collapsed condition.

Exemplary embodiments of the invention will be described with reference to FIGS. 5 to 24. Referring firstly to FIGS. 1 to 4, the principles of the invention will be described with reference to an expanding apparatus in the form of a simple ring. In this arrangement, the expanding apparatus, generally depicted at 10, comprises an expanding ring structure configured to be expanded from a first collapsed or unexpanded condition (shown in FIGS. 1A to 1D) and a second expanded condition (shown in FIGS. 2A to 2D). The apparatus of this arrangement and embodiments of the invention may be referred to as "expanding apparatus" for convenience, as they are operable to move to an expanded state from a normal collapsed state. However, the apparatus may equally be referred to as a collapsing apparatus, or an expanding or collapsing apparatus, as they are capable of being expanded or collapsed depending on operational state.

The expanding apparatus 10 comprises a plurality of elements 12 assembled together to form a ring structure 11. The elements 12 define an inner ring surface which is supported by the outer surface of cylinder 14. Each element comprises an inner surface 20, an outer surface 21 and first and second contact surfaces 22, 23. The first and second contact surfaces are oriented in non-parallel planes, which are tangential to a circle centred on the longitudinal axis of the apparatus. The planes converge towards the inner surface of the element. Therefore, each element is in the general form of a wedge, and the wedges are assembled together in a circumferentially overlapping fashion to form the ring structure 11. In use, the first and second contact surfaces of adjacent elements are mutually supportive.

Figure 3:
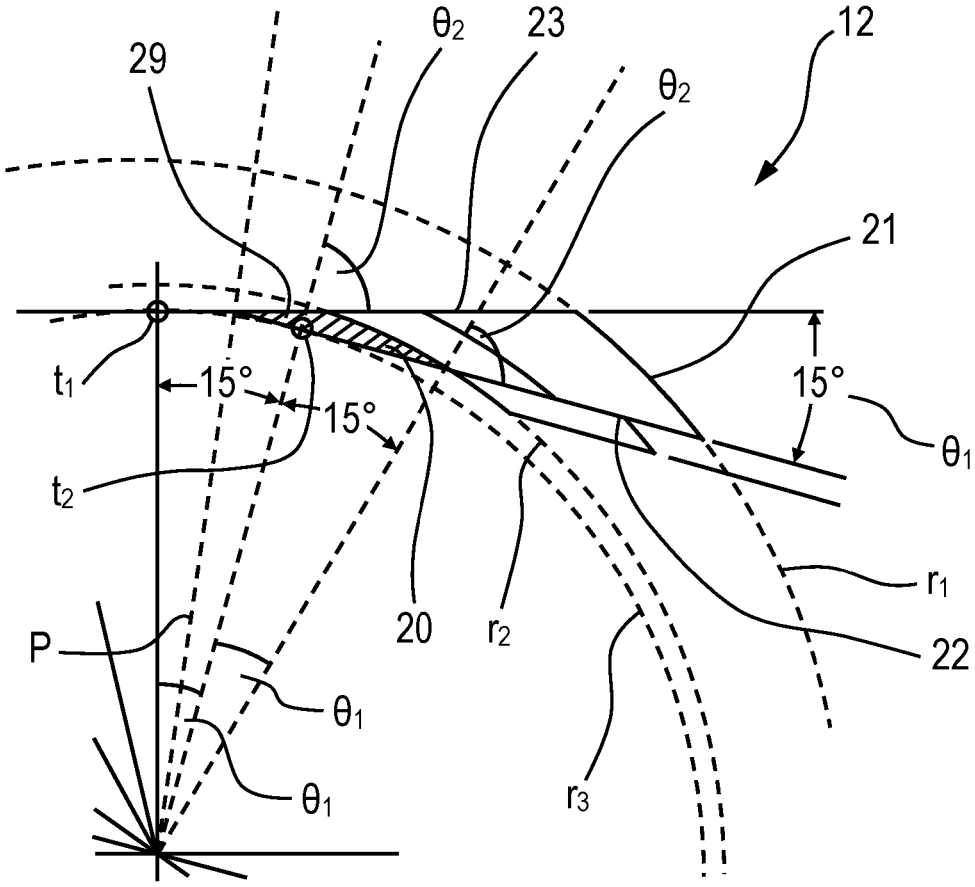
FIG. 3 is a geometric representation of an element of the apparatus of FIGS. 1A to 1D, shown from one side.
Figure 4A:
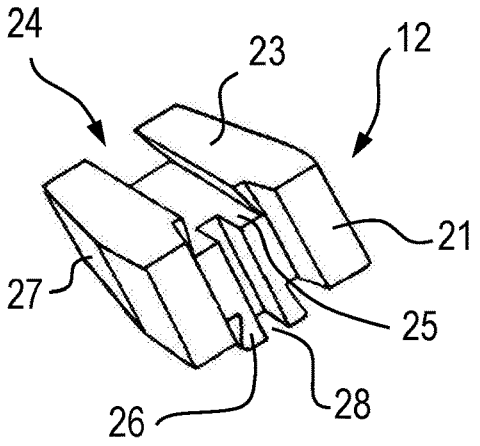
FIGS. 4A to 4F are respectively first perspective, second perspective, plan, first end, lower, and second end views of an element of the apparatus of FIGS. 1A to 1D.
Figure 4B:
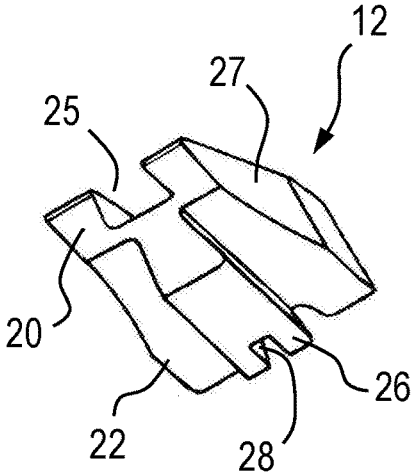
Figure 4C:
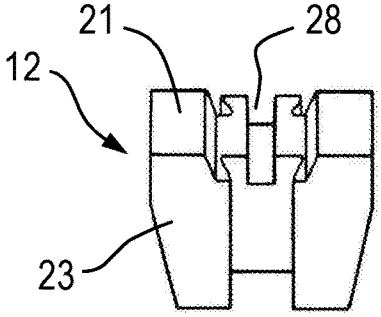
Figure 4D:
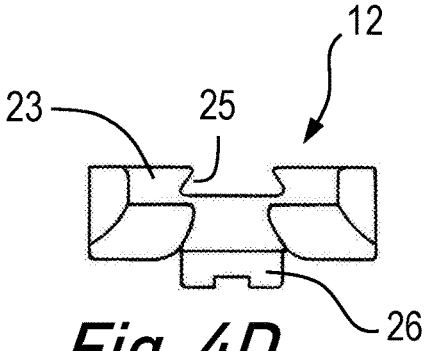
Figure 4E:
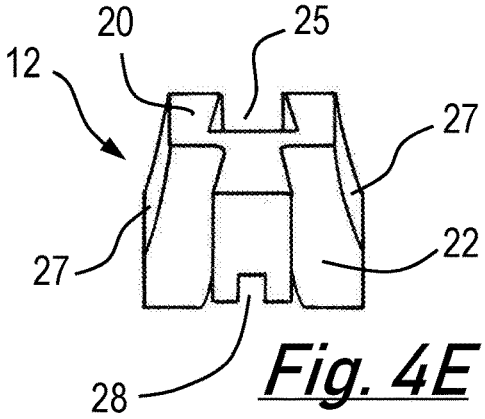
Figure 4F:
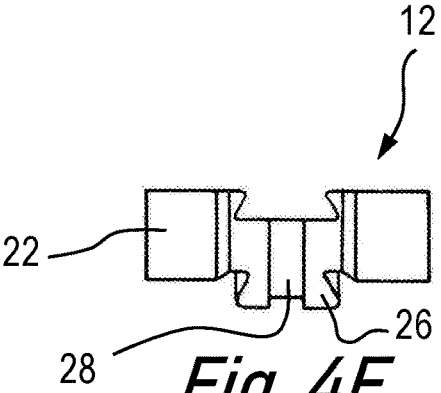

As most clearly shown in FIG. 3, when the ring structure is expanded to its optimal outer diameter, the orientation planes of the first and second contact surfaces intersect an inner surface of the ring structure, and together with the longitudinal axis of the apparatus, the lines of intersection define a sector of a cylinder. In this case, the ring structure is formed from twenty-four identical elements, and the central angle $\theta_1$ is 15 degrees. The angle described between the orientation planes of the first and second contact surface is the same as the central angle of the cylindrical sector, so that the elements are arranged rotationally symmetrically in the structure.

Each element is based on a notional wedge-shaped segment of a ring centred on an axis, with each notional wedge-shaped segment being inclined with respect to the radial direction of the ring. The nominal outer diameter of the segment is at the optimum expansion condition of the ring (with radius shown at $r_1$).

The orientation planes of the first and second contact surfaces of the element are tangential to a circle with radius $r_3$ concentric with the ring at points $t_1$, $t_2$. The angle described between the tangent points is equal to the angle $\theta_1$ of the segment. The orientation planes of the first and second contact surfaces of each notional wedge-shaped segment intersect one another on a radial plane P which bisects radial planes located at the tangent points (i.e. is at an angle of $\theta_1/2$ to both). This intersection plane P defines the expanding and collapsing path of the segment.

Figure 1B:
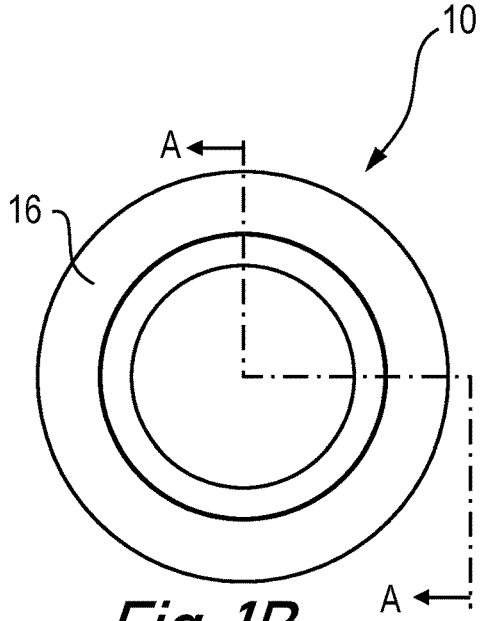
Figure 1D:
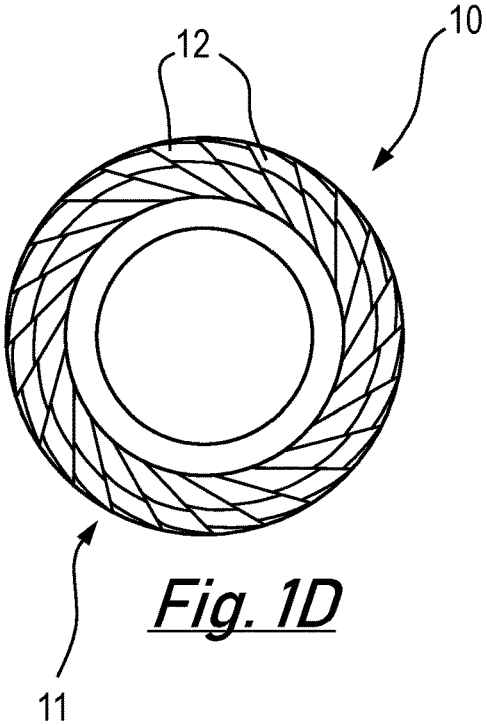
Figure 1C:
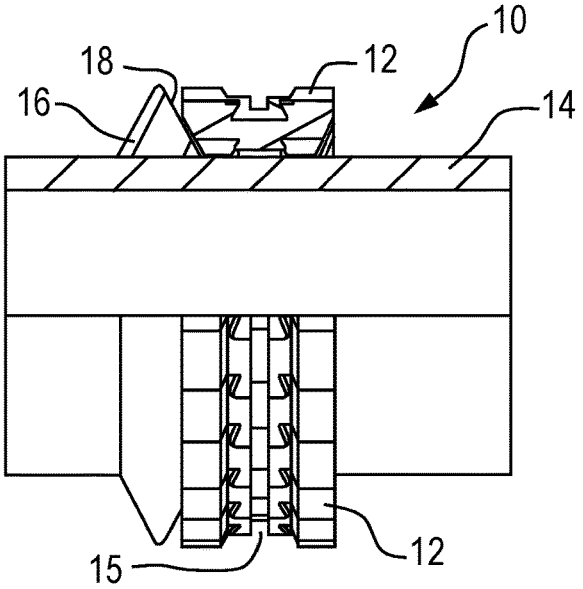
Figure 2A:
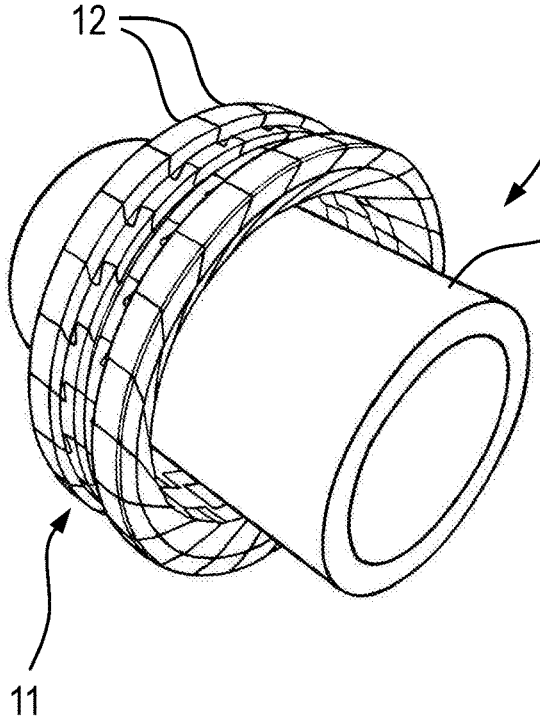
FIGS. 2A to 2D are respectively perspective, first side, part sectional and second side views of the apparatus of FIGS. 1A to 1D, shown in an expanded condition.
Figure 2B:
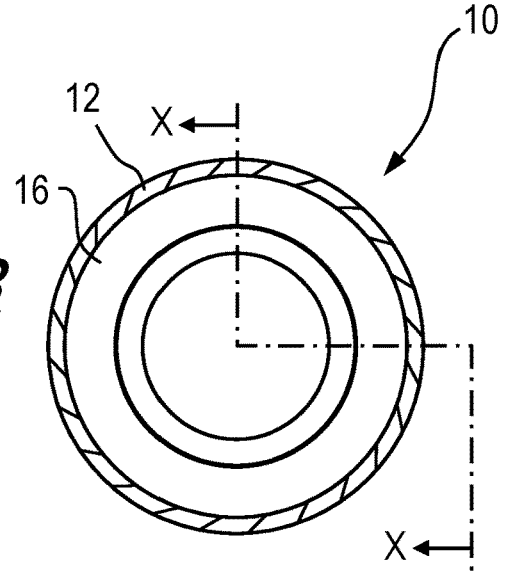
Figure 2D:
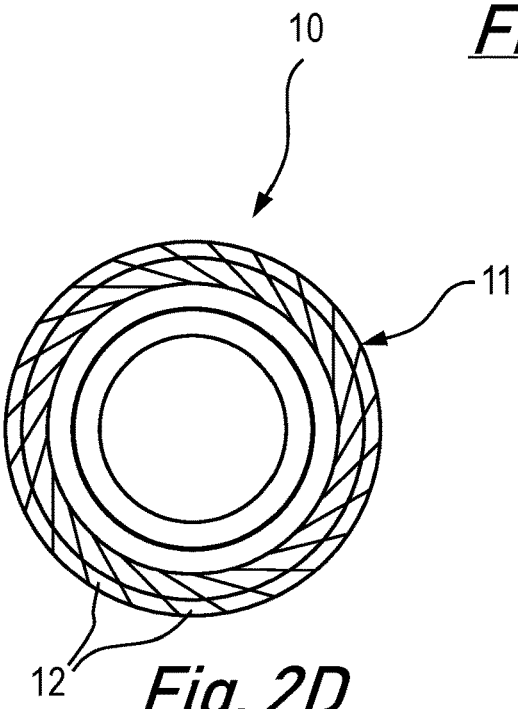
Figure 2C:
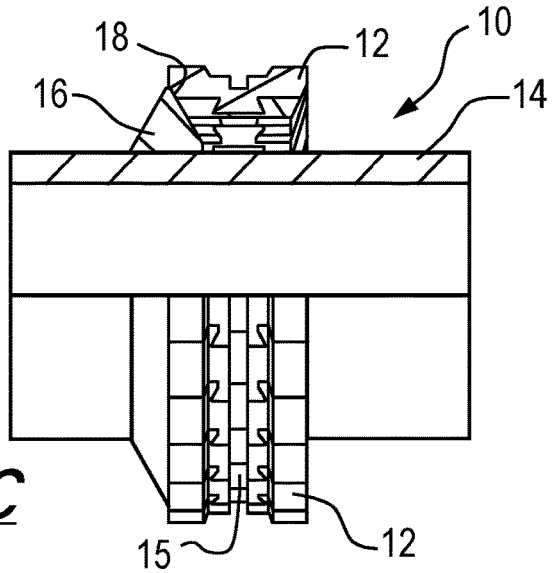

In the configuration shown in FIGS. 1 and 2, notional wedge-shaped segments are modified by removal of the tips 29 of the wedges, to provide a curved or arced inner surface 20 with radius $r_2$ when the ring is in its expanded condition shown in FIGS. 2A and 2D. The modification of the wedge-shaped elements can be thought of as an increase in diameter of an internal bore through the ring structure by $2(r_2-r_3)$, or a truncation of the inner diameter. This change in the inner diameter from the notional inner diameter $r_3$ to which the contact surfaces are tangential to a truncated inner diameter $r_2$, has the effect of changing an angle between the contact surfaces and the radial plane from the centre of the ring. Taking angle $\theta_2$ to be the angle described between the contact surface and a radial plane defined between the centre point of the ring structure and the point at which the orientation surface meets or intersects a circle at the radial position of the inner surface, $\theta_2$ is changed in dependence on the amount by which the segment has its inner diameter truncated. For the notional wedge shaped segment, the orientation planes of the contact surfaces are tangential to a circle at the inner diameter at $r_1$ (i.e. angle $\theta_2$ is 90 degrees). For the modified elements 12, the orientation planes of the contact surfaces instead intersect a circle at the (increased) inner diameter at $r_2$ and are inclined at a reduced angle $\theta_2$.

The angle $\theta_2$ at which the segment is inclined is related to the amount of material removed from the notional wedge-shaped segment, but is independent from the central angle $\theta_1$ of the wedge. Angle $\theta_2$ is selected to provide element dimensions suitable for manufacture, robustness, and fit within the desired annular volume and inner and outer diameters of the collapsed ring. As the angle $\theta_2$ approaches 90 degrees, a shallower, finer wedge profile is created by the element, which may enable optimisation of the collapsed volume of the ring structure. Although a shallower, finer wedge profile may have the effect of reducing the size of the gaps created at the inner surface of the ring in the collapsed condition and/or enabling a more compact collapsed condition, there are some consequences. These include the introduction of flat sections at the inner surfaces of the elements, which manifest as spaces at the inner diameter of the ring when in an expanded or partially expanded condition. When $\theta_2$=90 degrees, at the segments are purely tangential to inner diameter, the collapsed volume for a given outer diameter and inner diameter is most efficient, but the inner surface of the ring structure is polygonal with flat sections created by each segment. In some configurations, these flat sections may be undesirable. There may also be potential difficulties with manufacture of the elements and robustness of the elements and assembled ring structure. However, in many applications, where the profile of the inner surface of the expanded ring is not critical, for example when the inner diameter of the ring structure is floating, and/or the true inner diameter is defined by an actuation wedge profile rather than the inner surface of the ring, this compromise may not be detrimental to the operation of the apparatus, and the reduced collapse volume may justify an inclination angle $\theta_2$ of (or approaching) 90 degrees.

In the apparatus of FIGS. 1 to 4, the angle $\theta_2$ is 75 degrees. Relaxing $\theta_2$ to a reduced angle provides a smooth outer diameter and inner diameter profile to the expanded ring, as a portion of the inner circular arc is retained at the expense of slightly increased collapsed volume. It should be noted that the angle $\theta_2$ is independent from the angle $\theta_1$. Where the ring structure is desired to have a circular inner surface, preferred arrangements may have an angle $\theta_2$ which is in the range of (90 degrees-$2\theta_1$) to 90 degrees inclusive, and particularly preferred arrangements have an angle $\theta_2$ in the range of 70 degrees to 90 degrees (most preferably in the range of 73 degrees to 90 degrees). In general, to provide sufficient truncation of the inner diameter to retain a useful portion of an inner arc and provide a smooth inner surface to the ring structure, a maximum useful value of $\theta_2$ is (90 degrees-$\theta_1/2$). This would be 82.5 degrees in the described arrangements.

In other configurations, also in accordance with embodiments of the invention (and as will be described below) the geometry of the notional wedge-shaped segments forming the elements may be unmodified (save for the provision of functional formations such as for interlocking and/or retention of the elements), without the removal of material from the tip of the notional wedge-shaped segments. Such embodiments may be preferred when there is no requirement for the ring structure to have a circular inner surface.

As most clearly shown in FIGS. 4A to 4F, the first and second contact surfaces of the element have corresponding interlocking profiles 24 formed therein, such that adjacent elements can interlock with one another. In this case, the interlocking profiles comprise a dovetail groove 25 and a corresponding dovetail tongue 26. The interlocking profiles resist circumferential and/or radial separation of the elements in the ring structure, but permit relative sliding motion between adjacent elements. The interlocking profiles also facilitate smooth and uniform expansion and contraction of the elements during use. It will be appreciated that alternative forms of interlocking profiles, for example comprising recesses and protrusions of other shapes and forms, may be used within the scope of the invention.

The elements are also provided with inclined side wall portions 27, which may facilitate deployment of the apparatus in use. The side wall portions are formed in an inverted cone shape which corresponds to the shape and curvature of the actuating cone wedges profiles when the apparatus is in its maximum load condition (typically at its optimum expansion condition).

Each element is also provided with a groove 28, and in the assembled ring structure, the grooves are aligned to provide a circular groove which extends around the ring. The groove accommodates a biasing element (not shown), for example a spiral retaining ring of the type marketed by Smalley Steel Ring Company under the Spirolox brand, or a garter spring. In this case, the biasing means is located around the outer surface of the elements, to bias the apparatus towards the collapsed condition shown in FIGS. 1A to 1D. Although one groove for accommodating a biasing means is provided in this arrangement, in embodiments of the invention, multiple grooves and biasing means may be provided.

The apparatus 10 comprises a wedge member 16, which in this case is an annular ring having a conical surface 18 opposing one side of the ring structure 11. The wedge angle corresponds with the angle of the inclined conical side walls 27 of the elements. A corresponding wedge shaped profile (not shown) is optionally provided on the opposing side of the ring structure to facilitate expansion of the ring elements. In alternative arrangements this optional additional wedge may be substituted with an abutment shoulder.

Operation of the expansion apparatus 10 will now be described. In the first, collapsed or unexpanded condition, shown most clearly in FIG. 1C, the elements are assembled in a ring structure 11 which extends to a first outer diameter. In this configuration, and as shown in FIGS. 1B and 1C, the wedge member 16 defines the maximum outer diameter of the apparatus in the first condition. The elements are biased towards the unexpanded condition by a spiral retaining ring (not shown), and are supported on the inner surface by the outer surface of the cylinder 14.

In use, an axial actuation force is imparted on the wedge member 16. Any of a number of suitable means known in the art can be used for application of the axial actuation force, for example, the application of a force from an outer sleeve positioned around the cylinder. The force causes the wedge member 16 to move axially with respect to the cylinder, and transfer a component of the axial force onto the recessed side wall of the elements. The angle of the wedge transfers a radial force component to the elements 12, which causes them to slide with respect to one another along their respective contact surfaces.

The movement of the expanding elements is tangential to a circle defined around the longitudinal axis of the apparatus. The contact surfaces of the elements mutually support one another before, during, and after expansion. The radial position of the elements increases on continued application of the axial actuation force until the elements are located at a desired outer radial position. This radial position may be defined by a controlled and limited axial displacement of the wedge member, or alternatively can be determined by an inner surface of a bore or tubular in which the apparatus is disposed.

FIGS. 2A to 2D show clearly the apparatus in its expanded condition. At an optimal expansion condition, shown in FIGS. 2B and 2D, the outer surfaces of the individual elements combine to form a complete circle with no gaps in between the individual elements. The outer surface of the expansion apparatus can be optimised for a specific diameter, to form a perfectly round expanded ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of the described arrangement that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. With deployment of the elements in the plane of the ring structure, the overall width of the ring structure does not change. This enables use of the apparatus in close axial proximity to other functional elements.

The apparatus has a range of applications, some of which are illustrated in the following example embodiments. However, additional applications of the apparatus are possible which exploit its ability to effectively perform one or more of blocking or sealing an annular path; contacting an auxiliary surface; gripping or anchoring against an auxiliary surface; locating or engaging with radially spaced profiles; and/or supporting a radially spaced component.

Aspects of the present invention extend the principles described above to expanding apparatus comprising combinations of structural elements, ring elements, and combinations thereof, which have particular applications and advantages to systems in which an increased expansion ratio is desirable. The following embodiments of the invention describe examples of such apparatus.

Figure 5A:
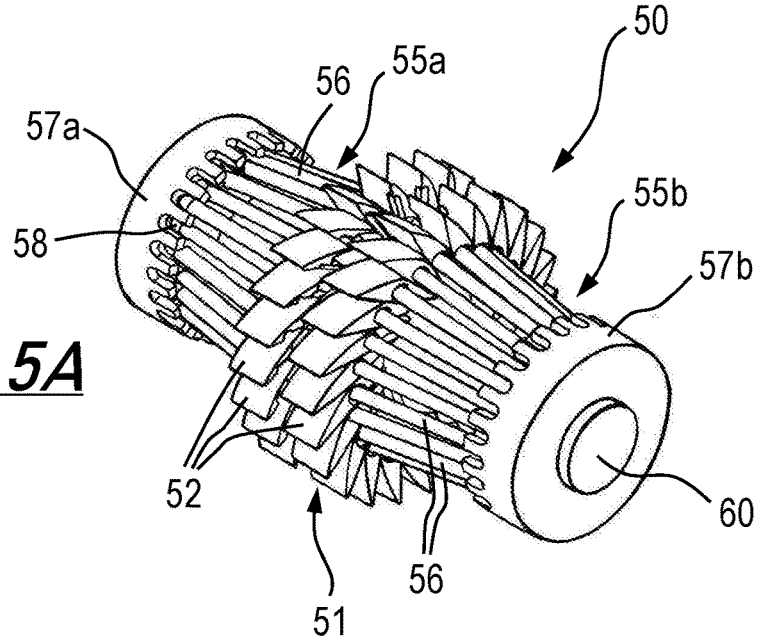
FIGS. 5A to 5C are respectively isometric, side and end views of an apparatus according to an embodiment of the invention in a collapsed condition.
Figure 5B:
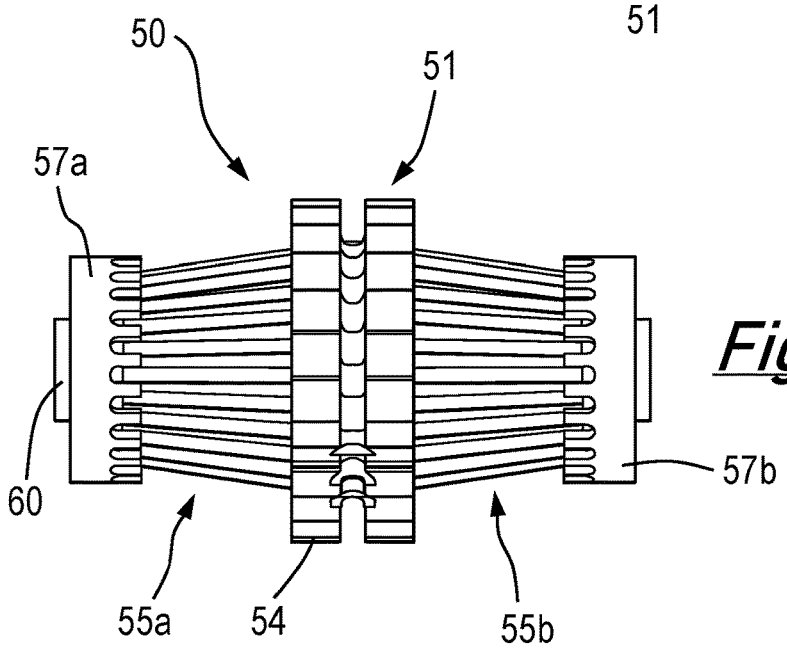
Figure 5C:
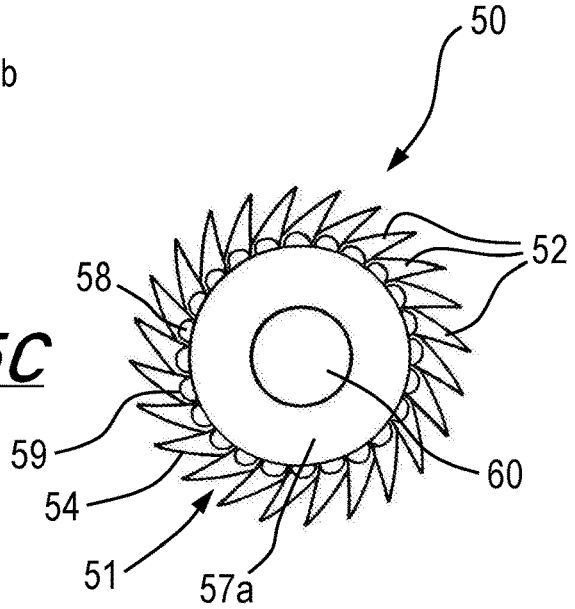
Figure 6A:
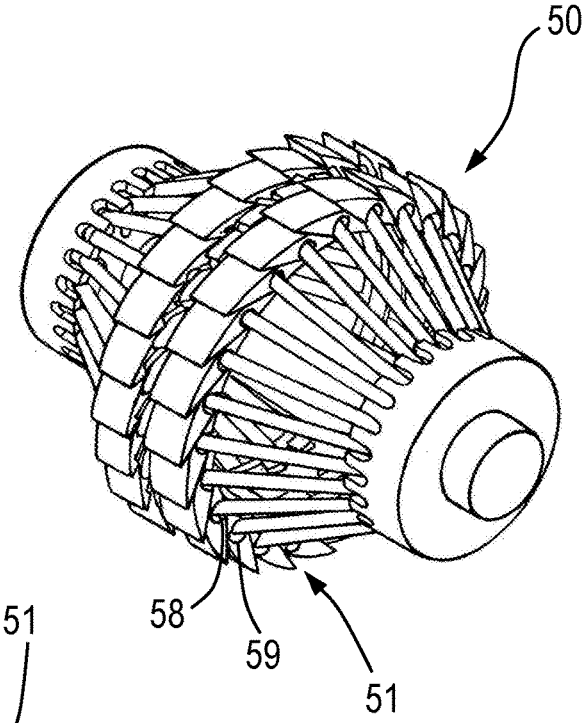
FIGS. 6A to 6C are respectively isometric, side and end views of the apparatus of FIGS. 5A to 5C in a partially expanded condition.
Figure 6B:
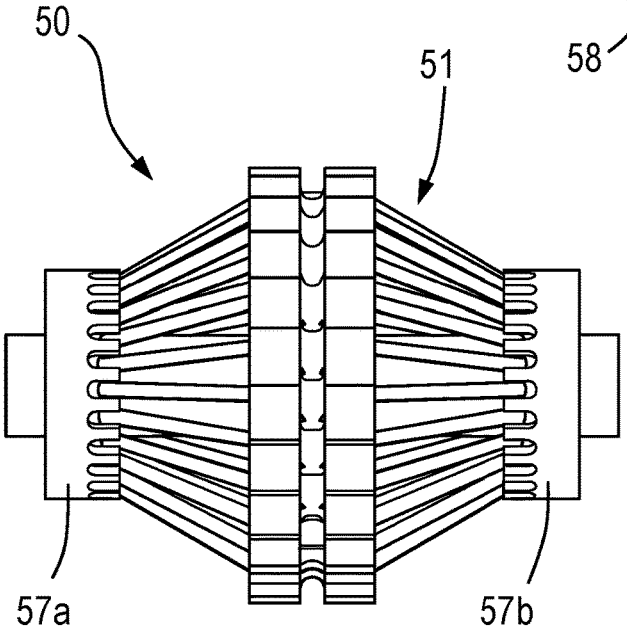
Figure 6C:
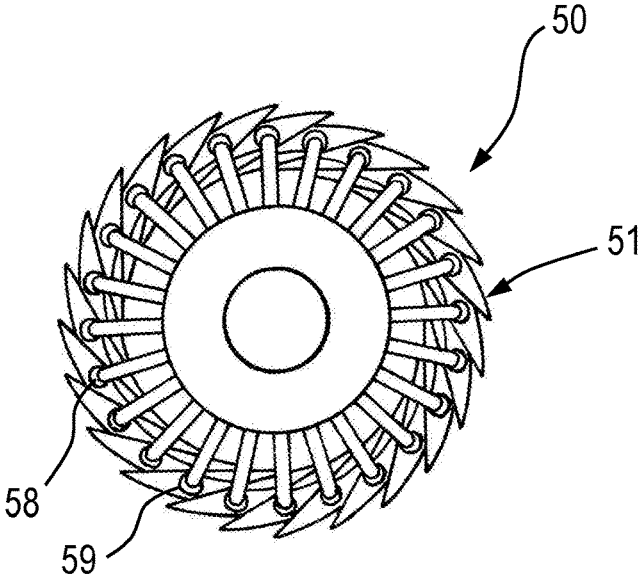

Referring now to FIGS. 5A to 7C, there is shown an expansion apparatus in accordance with a first embodiment of the invention. FIGS. 5A to 5C are respectively isometric, side and end views of an apparatus, generally shown at 50, shown in a collapsed condition on a central mandrel 60. FIGS. 6A to 6C are corresponding views of the apparatus 50 in a partially expanded condition and FIGS. 7A to 7C corresponding views of the apparatus 50 in a fully expanded condition.

The apparatus 50 comprises an expansion assembly 51 formed from a plurality of elements, including a set of ring elements 52 assembled together to form a centrally disposed ring structure 54, and two sets 55*a*, 55*b* of structural elements 56. The ring elements 52 are similar to the elements 12, and their form and function will be understood from FIGS. 1 to 4 and their accompanying description. The ring elements 52 are shown in more detail in FIGS. 8 and 9A to 9F, and comprise the inner and outer surfaces, first and second contact surfaces, interlocking profiles, and a groove for retaining a circumferential spring, which features are equivalent in form and function to the features of the elements 12. Biasing means in the form of a circumferential spring (not shown) retains the centre ring structure in its collapsed condition shown in FIGS. 5A to 5C.

The geometry of the individual ring elements 52 differs from the geometry of the ring elements 12, in that the elements are based on a notional wedge-shaped segment which is unmodified (save for the provision of functional formations such as for interlocking and/or retention of the elements), and without the removal of material from the tip of the notional wedge-shaped segments. This arrangement may be preferred when there is no requirement for the ring structure to have a circular inner surface, as is the case with the "floating" ring structure of the apparatus 50.

Each element comprises an outer surface 221 and first and second contact surfaces 222, 223. The first and second contact surfaces are oriented in non-parallel planes, which are tangential to a circle centred on the longitudinal axis of the apparatus with radius r3. The inner surface of the ring structure is defined at r3, and therefore the orientation planes are fully tangential (and angle θ2 is 90 degrees). The planes converge towards the inner surface of the element to an intersection line on a radial plane P which bisects the radial planes at the tangent points (i.e. is at an angle of θ1/2 to both). This intersection plane P defines the expanding and collapsing path of the segment. Therefore, each element is in the general form of a wedge, and the wedges are assembled together in a circumferentially overlapping fashion to form the ring structure 54. In use, the first and second contact surfaces 222, 223 of adjacent elements are mutually supportive.

In this case, the ring structure 54 is formed from twenty-four identical elements, and the angle described between the first and second contact surfaces is 15 degrees, so that the elements are arranged rotationally symmetrically in the structure.

As most clearly shown in FIGS. 9A to 9F, the first and second contact surfaces of the element have corresponding interlocking profiles 224 formed therein, such that adjacent elements can interlock with one another. In this case, the interlocking profiles comprise a dovetail groove 225 and a corresponding dovetail tongue 226. The interlocking profiles resist circumferential and/or radial separation of the elements in the ring structure, but permit relative sliding motion between adjacent elements. The interlocking profiles also facilitate smooth and uniform expansion and contraction of the elements during use. The elements 52 differ from the elements 12 in that the tongue and groove are inverted, with the tongue on the element 52 on the (longer) contact surface 223. This facilitates increased contact between adjacent elements throughout the expanding and contracted range. It will be appreciated that alternative forms of interlocking profiles, for example comprising recesses and protrusions of other shapes and forms, may be used within the scope of the invention.

Each element is also provided with a groove 228, and in the assembled ring structure, the grooves are aligned to provide a circular groove which extends around the ring. The groove accommodates a biasing element (not shown), for example a spiral retaining ring of the type marketed by Smalley Steel Ring Company under the Spirolox brand, or a garter spring. In this case, the biasing means is located around the outer surface of the elements, to bias the apparatus towards the collapsed condition shown in FIGS. 5A to 5D. Although one groove for accommodating a biasing means is provided in this arrangement, in embodiments of the invention, multiple grooves and biasing means may be provided.

The structural elements 56 are in the form of spokes or struts. First ends of each of the spokes 56 are connected to a respective retaining ring 57 *a*, 57 *b*. Each ring element 52 is connected to a pair of spokes 56, one from each of the respective sets 55 *a*, 55 *b*, at their second ends. The first and second ends are provided with balls or knuckles 58, which are received in respective sockets 59 (not shown in FIG. 8 or 9 for clarity of the geometry) in the retaining rings and ring elements to create a pivoting and rotating connection. In a first, collapsed condition, the apparatus has a first outer diameter, which is defined by the outer edges of the ring elements 52.

Operation of this embodiment of the apparatus will be described, with additional reference to FIGS. 6A to 7C. The apparatus is actuated to be radially expanded to a second diameter by an axial actuation force, which acts on one or both of the retaining rings to move one or both with respect to the mandrel 60. The retaining rings function as pusher rings for the apparatus. Any of several suitable means known in the art can be used for application of the axial actuation force, for example, the application of a force from an outer sleeve positioned around the cylinder. The axial actuation force acts through the sets of spokes to impart axial and radial force components onto the ring elements. The pivot point between the ring elements and the spoke is set radially further out from the mandrel than the pivot point between the retaining rings and the spokes. This ensures that any compressive force on the end rings has a radial component to act radially on the ring element. Radial expansion of the ring structure 54 is initially resisted by the circumferential spring. When the force of the spring is overcome, the ring elements of the centre ring structure are moved radially outward from the collapsed position, towards the partially expanded condition shown in FIGS. 6A to 6C. As the ring structure 54 moves radially outward, the spokes pivot with respect to the retaining rings and the ring elements to create a pair of substantially conical supports for the ring structure 54. The ring elements 52 slide tangentially with respect to one another to expand the centre ring structure as the first ends of the spokes are moved towards one another.

Figure 7A:
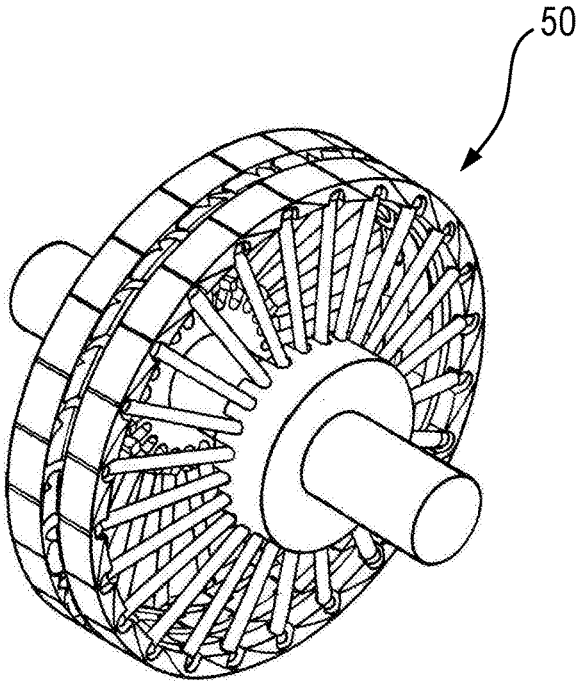
FIGS. 7A to 7C are respectively isometric side and end views of the apparatus of FIGS. 5A to 5C in a fully expanded condition.
Figure 7B:
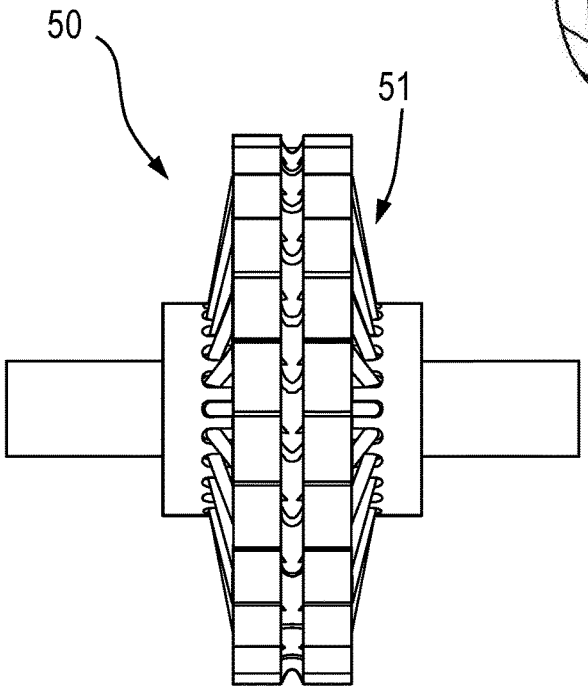
Figure 7C:
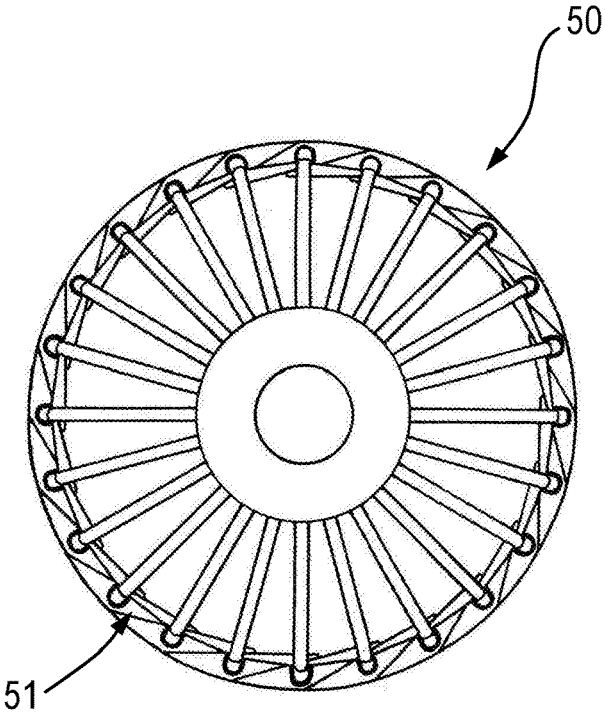
Figure 8:
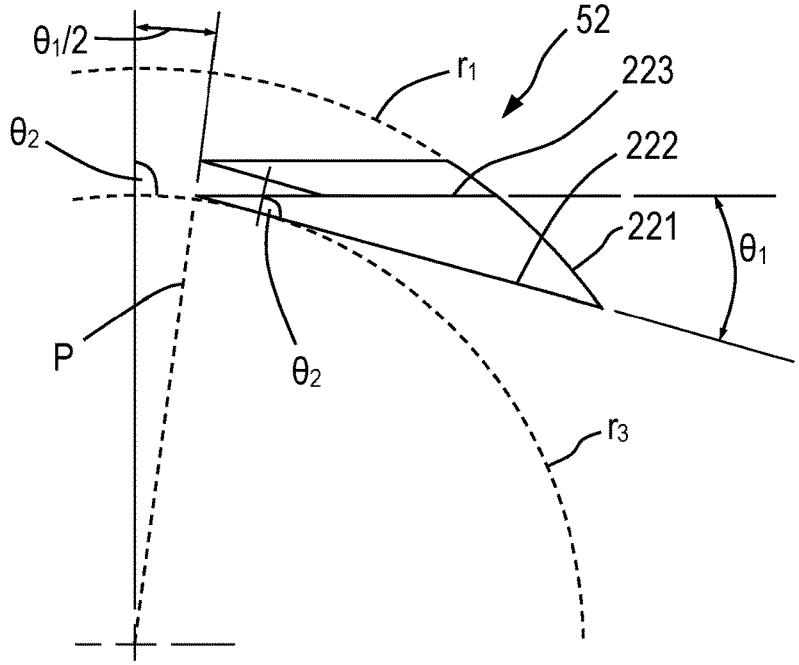
FIG. 8 is a geometric representation of an element of the apparatus of FIGS. 5A to 5C, shown from one side.
Figure 9A:
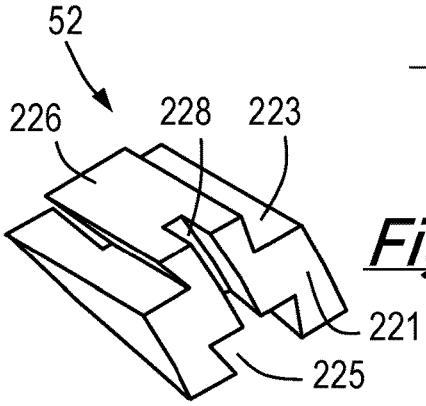
FIGS. 9A to 9F are respectively first perspective, second perspective, plan, first end, lower, and second end views of an element of the apparatus of FIGS. 5A to 5C.
Figure 9D:
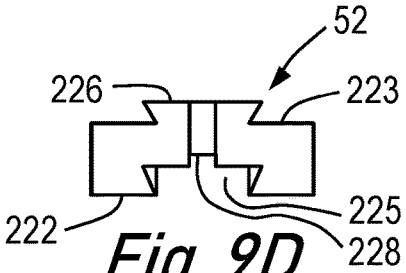
Figure 9B:
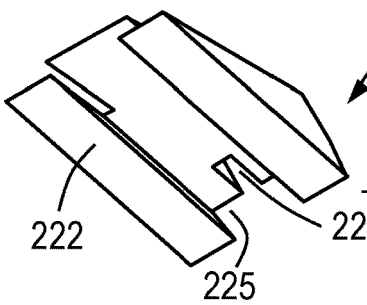
Figure 9E:
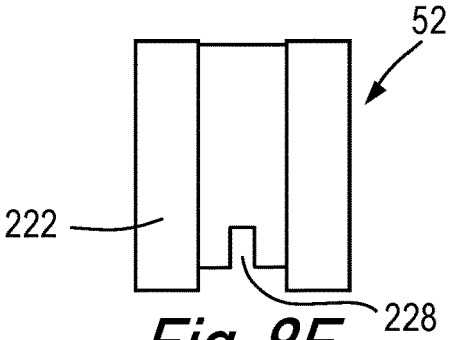
Figure 9C:
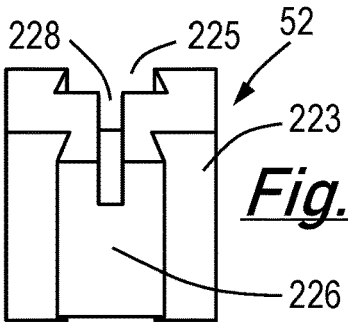
Figure 9F:
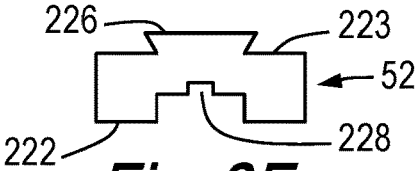

As the retaining rings and sets of spokes are brought towards the position shown in FIGS. 7A to 7C, the ring elements 52 slide with respect to one another into the radially expanded condition. The radial movement of the elements of the outer rings is the same as the movement of the elements described with reference to FIGS. 1 to 4: the ring elements slide with respect to one another in a tangential direction, while remaining in mutually supportive planar contact. The interlocking arrangement of the ring elements enables the apparatus to move uniformly between the contracted and expanded condition.

The resulting expanded condition is shown in FIGS. 7A to 7C. The apparatus forms an expanded ring structure which is solid, with no gaps between its elements, and which has a smooth circular outer surface at its fully expanded condition. The outer diameter of the expanded ring is significantly greater than the outer diameter of the ring structures in their collapsed state, with the increased expansion resulting from the combination of sets of structural elements supporting the ring structure 54. The open structure of the conical support renders this embodiment particularly suitable for applications such as lightweight centralisation, swaging applications, removable support structures, and/or adjustable drift tools.

Maintaining the axial force on the retaining rings will keep the apparatus in an expanded condition, and a reduction in the axial force to separate the retaining rings enables the ring structure and sets of spokes to collapse under the retention forces of the spring element. Collapsing of the apparatus to a collapsed condition is therefore achieved by releasing the axial actuation force. Separation of the retaining rings collapses the ring structure under the retaining force of its biasing spring, back to the collapsed position shown in FIGS. 5A to 5C.

In addition, the connections between the spokes and the ring elements, and the spokes and the retaining ring (which in this embodiment are ball and socket or knuckle and socket connections), are configured to enable the transfer of a tensile force. This enables a tension to be pulled between the retaining rings, the structural elements and the ring elements (or vice versa). This axial interlocking of the spokes and ring elements ties the components together longitudinally, and enables a tension to be pulled between the elements to retract the apparatus towards or to its collapsed condition. Pulling a tension may facilitate collapsing of the apparatus to its original outer diameter, in conjunction with the action of a biasing spring, or in alternative embodiments, the tensile force may be used to retract the apparatus without the use of a biasing spring. The apparatus may therefore be a passive device, with no default condition defined by a biasing means.

The combination of structural elements and the ring structure enables the provision of an expanding and collapsing apparatus having the advantages of an expanded ring structure that is solid, with no gaps between its elements, and a smooth circular outer surface at its fully expanded condition, with increased maximum expansion ratios. The arrangements provide increased maximum expansion ratios with few additional moving parts and little increase in complexity over with the ring structure of FIGS. 1 to 4.

Figure 10A:
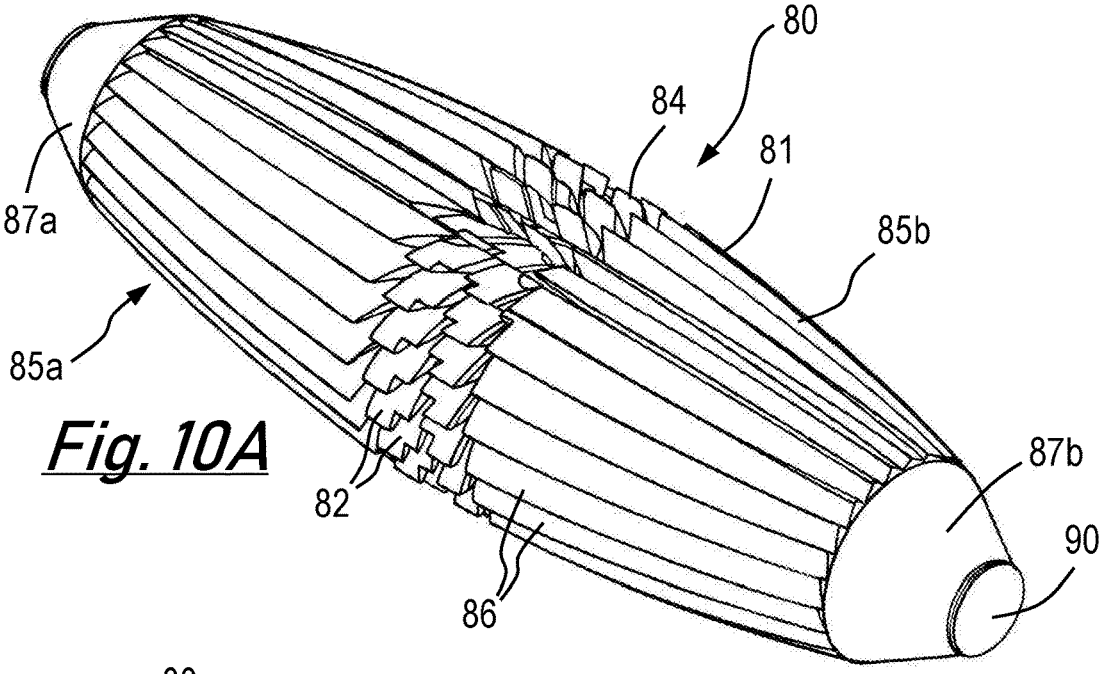
FIGS. 10A and 10B are respectively isometric and longitudinal sectional views of an apparatus according to an alternative embodiment of the invention in a collapsed position.
Figure 10B:
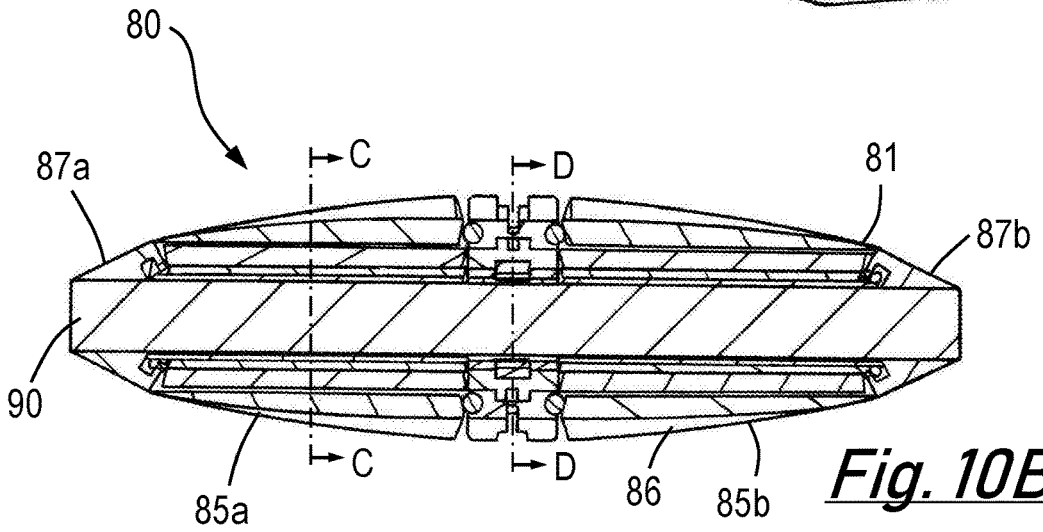
Figure 10C:
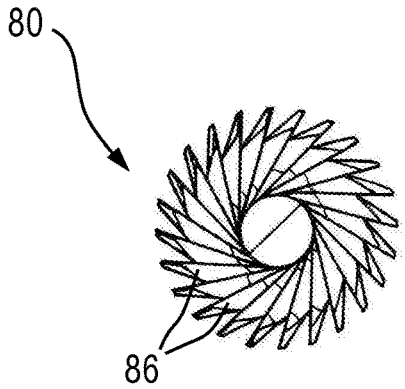
FIGS. 10C and 10D are respectively cross sectional views of the apparatus of FIGS. 10A and 10B through lines C-C and D-D.
Figure 10D:
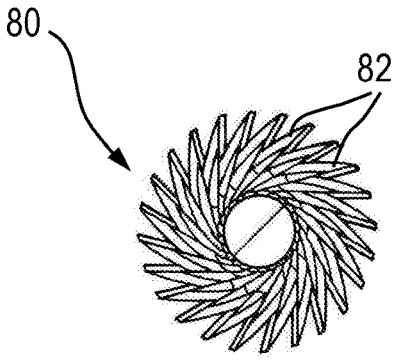
Figure 11A:
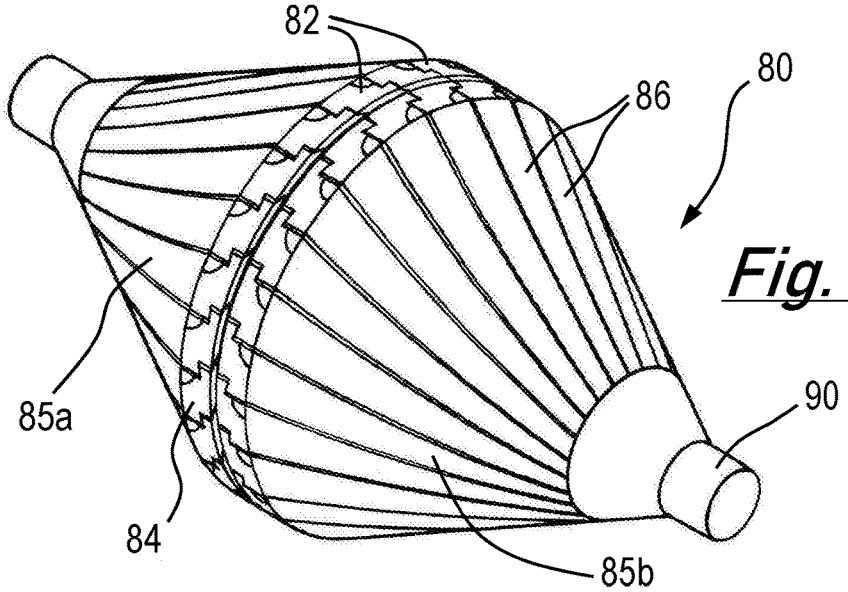
FIGS. 11A and 11B are respectively isometric and longitudinal sectional views of the apparatus of FIGS. 10A to 10D in an expanded condition.
Figure 11B:
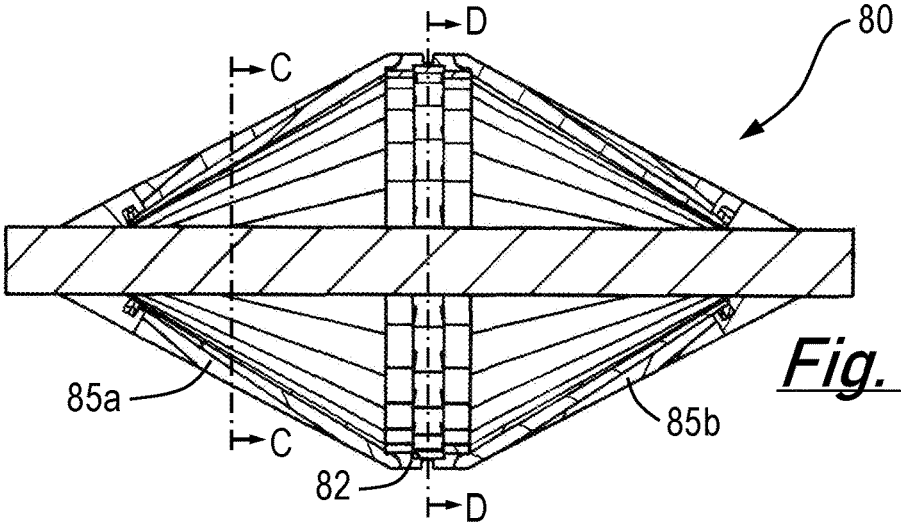
Figure 11C:
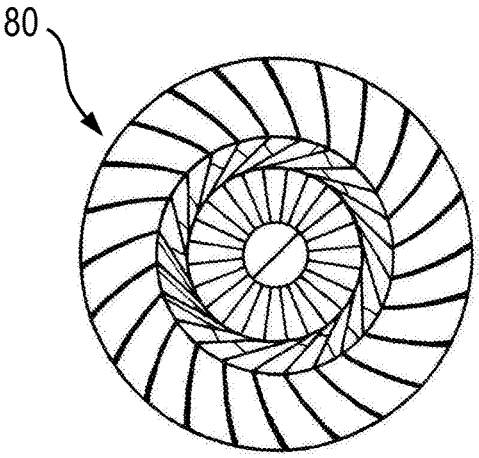
FIGS. 11C and 11D are respectively cross sectional views of the apparatus of FIGS. 11A and 11B through lines C-C and D-D respectively.
Figure 11D:
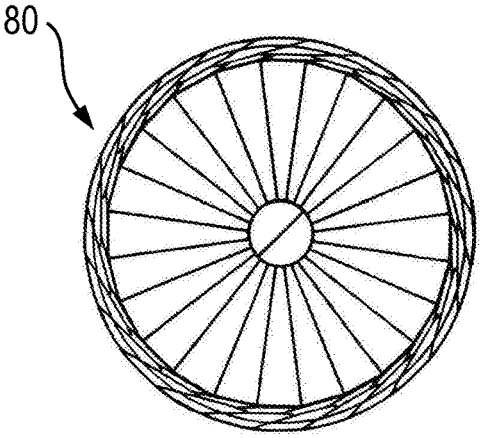
Figure 12:
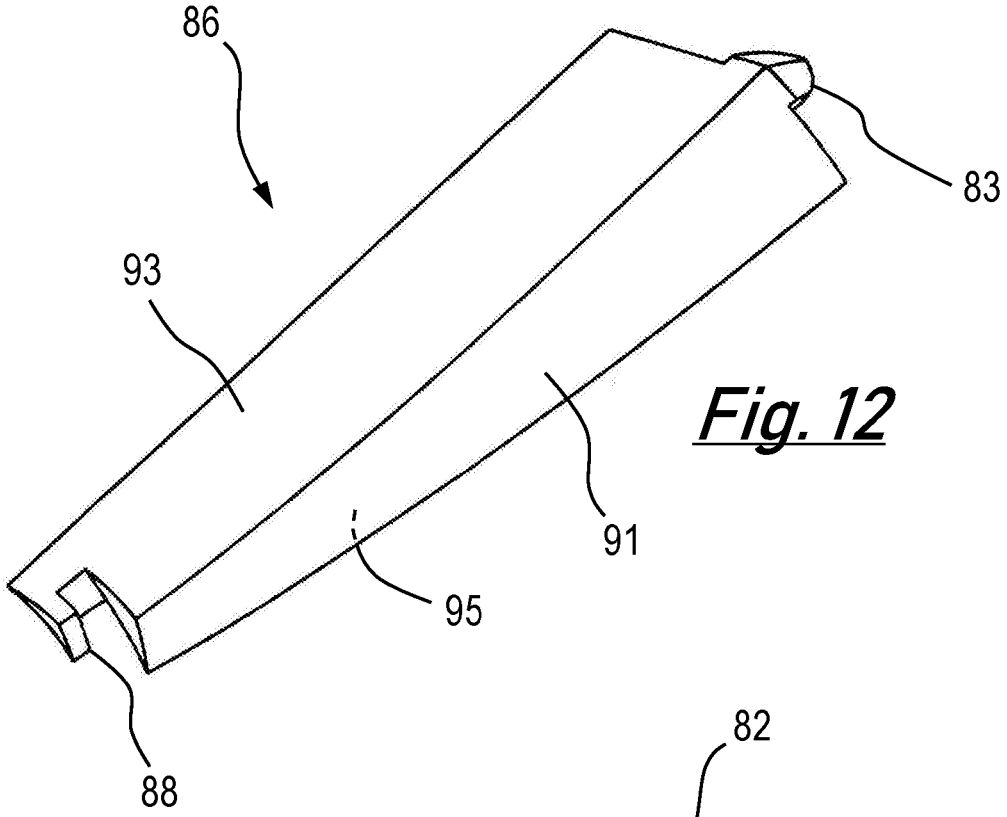
FIG. 12 is an isometric view of a structural element of the apparatus of FIGS. 10A to 10D.

Referring now to FIGS. 10A to 11D, there is shown an expanding and collapsing apparatus according to an alternative embodiment of the invention, generally depicted at 80. FIGS. 10A and 10B are respectively isometric and longitudinal sectional views of the apparatus in a collapsed position, and FIGS. 10C and 10D are respectively cross sectional views of the through lines C-C and D-D of FIG. 10B. FIGS. 11A to 11D are corresponding views of the apparatus in an expanded condition.

Figure 13:
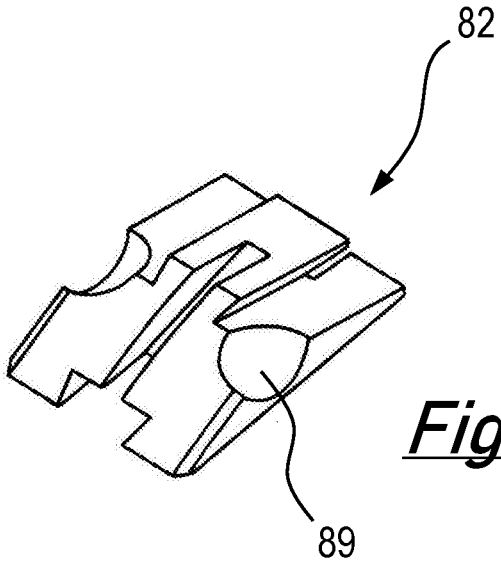
FIG. 13 is an isometric view of a ring element of the apparatus of FIGS. 10A to 10D.

The apparatus 80 is similar to the apparatus 50, and will be understood from FIGS. 5 to 9 and the accompanying description. The apparatus 80 comprises an expansion assembly 81 formed from a plurality of elements, including a set of ring elements 82 assembled to form a centrally disposed ring structure 84. The ring elements 82, most clearly shown in FIG. 13, are similar in form and function to the ring elements 52 of the previous embodiment of the invention. Two sets 85*a*, 85*b* of structural elements 86 are in the form of cone segments, shown most clearly in FIG. 12. The cone segment 86 has an outer surface 91, an upper planar contact surface 93, and a lower planar contact surface 95. First ends of each of the cone segment 86 are connected to a respective retaining ring 87*a*, 87*b* by a hook 88 for engaging with an undercut in the retaining ring. Each ring element 82 is connected to a pair of segments 86, one from each of the respective sets 85*a*, 85*b*, at their second ends. The second ends of the segments 86 are provided with balls or knuckles 83, which are received in respective recesses 89 in the ring elements to create a pivoting and rotating connection. In a first, collapsed condition, the apparatus has a first outer diameter, which is defined by the outer edges of the ring elements 84.

Operation of this embodiment of the apparatus is similar to the operation of the apparatus 50. The apparatus is actuated to be radially expanded to a second diameter by an axial actuation force, which acts on one or both of the retaining rings to move one or both with respect to the mandrel 90. The axial actuation force acts through the sets of cone segments to impart axial and radial force components onto the ring elements. Radial expansion of the ring structure 84 is initially resisted by the circumferential spring, but when the force of the spring is overcome, the ring elements of the central ring structure 84 are moved radially outward from the collapsed position, towards the expanded condition shown in FIGS. 11A to 11D. As the ring structure 84 moves radially outward, the segments pivot with respect to the retaining rings and the ring elements to create a pair of conical support structures for the ring 84. Each ring segment is supported in an A-frame arrangement. The ring elements 82 slide tangentially with respect to one another to expand the centre ring structure as the first ends of the cone segments are moved towards one another. In addition, on any selected plane along the length of the cone segment perpendicular to the longitudinal axis (for example section C-C of FIGS. 100 and 10D), the cone segment is moving tangentially to a circle that is in the selected plane and concentric with the longitudinal axis.

Figure 14A:
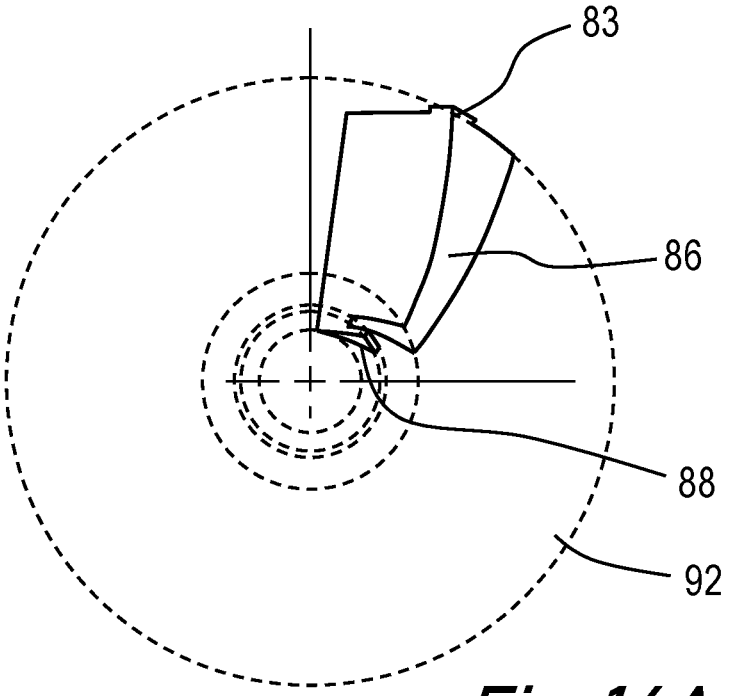
FIGS. 14A and 14B are views of the structural element of FIG. 12 with reference to a virtual cone of which the structural element is a segment.
Figure 14B:
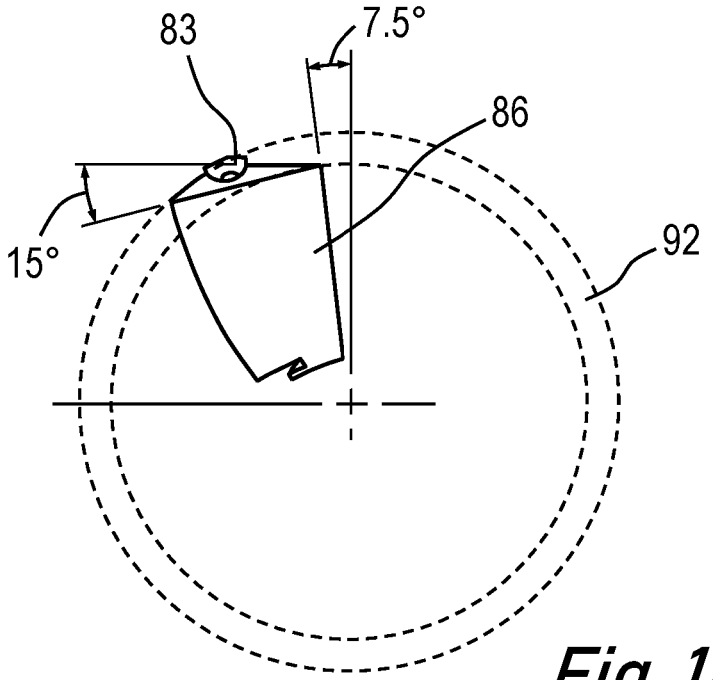
Figure 15A:
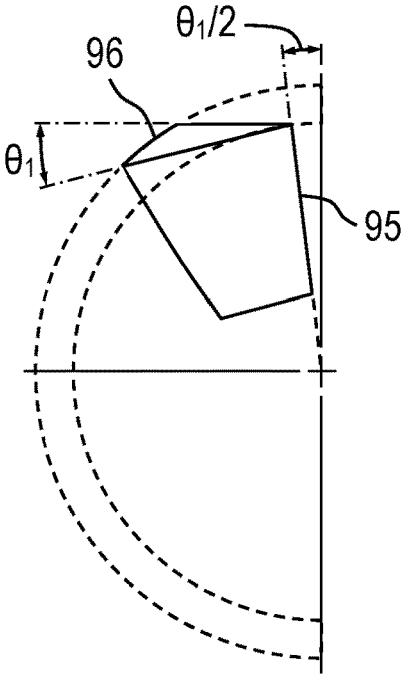
FIGS. 15A to 15C are geometric reference diagrams, useful for understanding how a structural element of an embodiment of the invention may be formed.
Figure 15B:
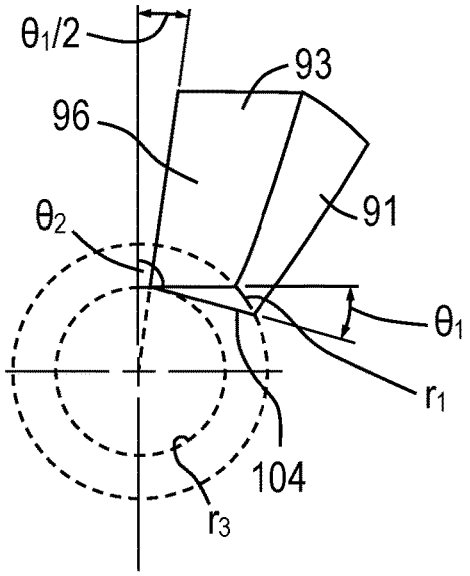
Figure 15C:
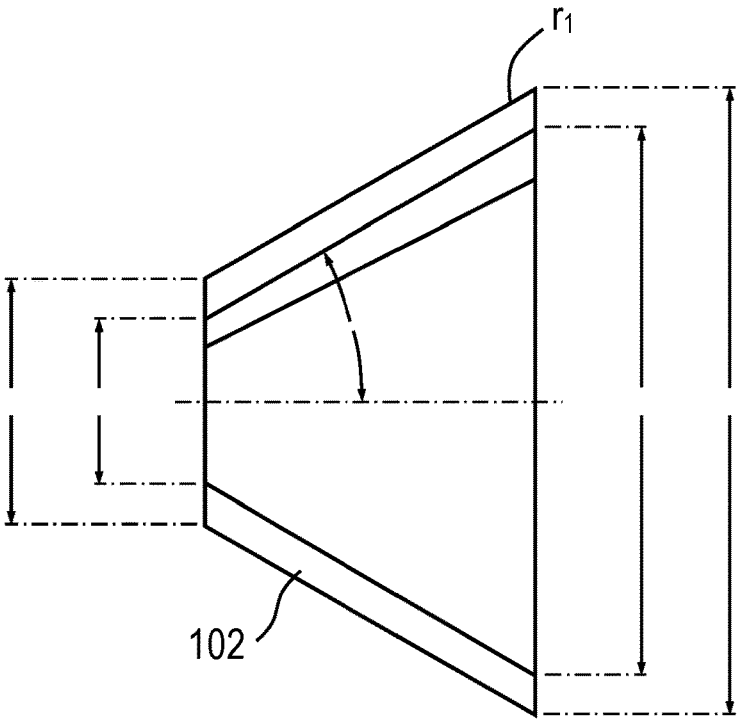

Movement of the cone segments 86 with respect to one another is governed by their shape, and FIGS. 14A, 14B, and 15A to 15C are useful for understanding the manner in which the shape of the cone segments is created in embodiments of the invention. FIGS. 14A and 14B show the cone segment 86, complete with hook 88 and knuckle 83, as a segment of a hollow cone 92. FIGS. 15A to 15C are geometric reference diagrams, useful for understanding how a simplified cone segment 96 of an embodiment of the invention may be formed.

Referring to FIGS. 15A to 15C, the starting point for forming the cone segment 96 is a hollow cone 102 (FIG. 15C), with an internal cone angle, minimum inner diameter and outer diameter, and maximum inner diameter and outer diameter. The cone can have any internal and external angle, and need not have a uniform wall thickness (although the example cone 102 does have a uniform wall thickness).

On the small end of the cone, as shown in FIG. 15B, the cross sectional profile of the cone segment is based on a notional wedge-shaped segment of a ring, as described with respect to previous embodiments. The ring is centred on an axis, with the notional wedge-shaped segment being inclined with respect to the radial direction of the ring. The nominal outer diameter of the segment is at the optimum expansion condition of the ring (with radius shown at $r_1$). As with the embodiment of FIGS. 5 to 9, the orientation planes of upper and lower contact surfaces of the segment element are tangential to a circle centred on the longitudinal axis of the apparatus with radius $r_3$. The inner surface of the ring structure is defined at $r_3$, and therefore the orientation planes are fully tangential (and angle $\theta_2$ is 90 degrees). The angle described between the tangent points is equal to the angle $\theta_1$ of the segment. The orientation planes of the first and second contact surfaces of each notional wedge-shaped segment intersect on a radial plane P which bisects the radial planes at the tangent points (i.e. is at an angle of $\theta_1/2$ to both). This intersection plane P defines the expanding and collapsing path of the segment.

In this apparatus, the segment angle $\theta_1$ is 15 degrees, and the radial plane P is inclined to the radial plane at the tangent point by 7.5 degrees.

Having determined the profile 104 of one end of the segment, the internal angle of the inside face of the cone 102 defines the inclined angle of the upper and lower planar surfaces of a formed segment which extend from the end profile 104. The upper planar surface 93 is defined by a cut through the body of the cone from the upper line of the end profile 104, where the cut remains tangential to the inner surface of the cone throughout the length of the cone. The lower planar surface 95 is defined by a cut through the body of the cone from the lower line of the end profile 104, where the cut remains tangential to the inner surface of the cone throughout the length of the cone. The outer surface 91 of the segment is simply the outer surface of cone between the upper and lower planar surfaces.

The geometry of a cross-section of the cone segment is the same at each position through the length of the segment: the outer surface 91 is at the nominal outer diameter of the segment at the optimum expansion condition of the ring; the first and second contact surfaces of the cone segment are tangential to the circle at radius $r_3$, and the orientation planes of the first and second contact surfaces intersect on a radial plane P inclined at an angle of $\theta_1/2$ to the radial planes at the tangent points. The same radial plane P can be described as being inclined to the upper contact surface by an angle of $90-\theta_1/2$ degrees and inclined to the lower contact surface by an angle of $90+\theta_1/2$.

This principle is used to determine the basic shape of the cone segment, which may then be detailed with additional features such as grooves and undercuts to create the functional cone segment 86.

In use, as the retaining rings 87 and sets of cone segments are brought towards the position shown in FIGS. 11A to 11D, the ring elements 82 and the structural ring elements 86 slide with respect to one another into the radially expanded condition. The radial movement of the elements of the outer rings is the same as the movement of the elements described with reference to FIGS. 1 to 4: the elements 82 and 86 slide with respect to one another in a tangential direction, while remaining in mutually supportive planar contact. The centrally positioned ring segments ensure that the outer structural segments remain held in a uniform pattern, equally spaced and evenly deployed. The expansion of the centre ring also controls the alignment and the order of the outer structural segments.

The resulting expanded condition is shown in FIGS. 11A to 11D. The apparatus is preferably expanded to an optimal expansion condition, at which the planar surfaces of cone segments are in full contact, and where the outer diameter defined by the ring structure 84 is slightly smaller than the inner diameter of a conduit or borehole in which the apparatus is located. Further thrust on the retaining rings causes over-expansion of the ring structure, without substantially affecting the surface profile of the conical or cylindrical ring structures.

Maintaining the axial force on the retaining rings will keep the apparatus in an expanded condition, and a reduction in the axial force to separate the retaining rings enables the ring structure and sets of spokes to collapse under the retention forces of the spring element. Collapsing of the apparatus to a collapsed condition is therefore achieved by releasing the axial actuation force. Separation of the retaining rings collapses the ring structure 82 under the retaining force of its biasing spring, back to the collapsed position shown in FIGS. 10A to 10C.

The combination of structural elements and the ring structure enables the provision of an expanding and collapsing apparatus with increased maximum expansion ratios. The arrangements provide increased maximum expansion ratios with few additional moving parts and little increase in complexity over with the ring structure of FIGS. 1 to 4. The apparatus forms an expanded ring structure which is solid, with no gaps between its elements, and which has a smooth circular outer surface at its fully expanded condition. In addition, the conical support structures created by the cone segments are formed as solid, smooth flanks of the expanded apparatus. This facilitates use of the conical structures as deployment or actuation devices, or support structures for seal elements and other mechanical structures, as will be described in more detail below.

Figure 16A:
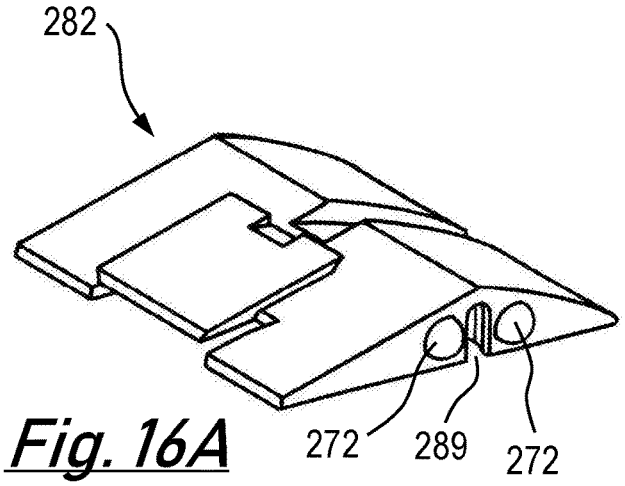
FIGS. 16A to 16C are respectively first isometric, lower, and second isometric end views of a ring element of an apparatus according to an alternative embodiment of the invention.
Figure 16B:
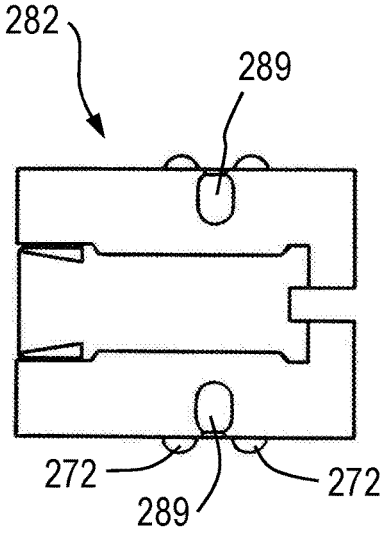
Figure 16C:
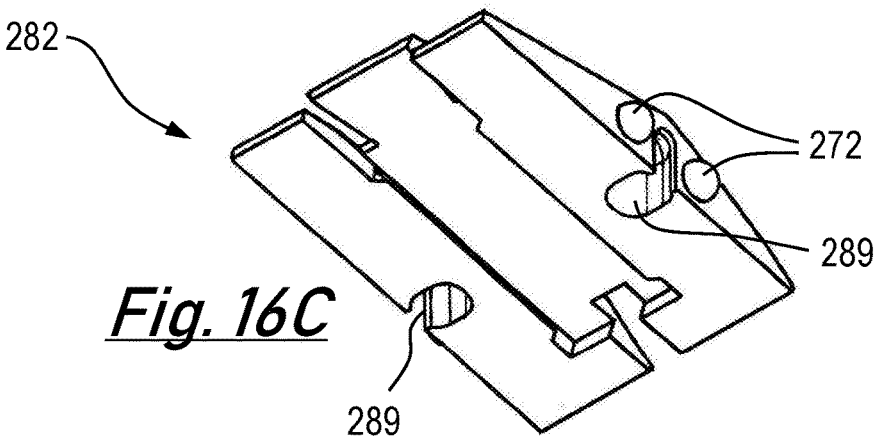
Figure 17A:
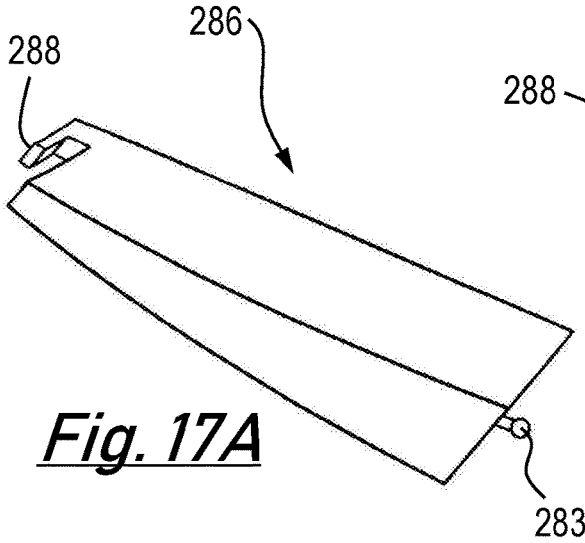
FIGS. 17A and 17B are respectively first and second isometric views of a structural element of an apparatus according to an alternative embodiment of the invention.
Figure 17B:
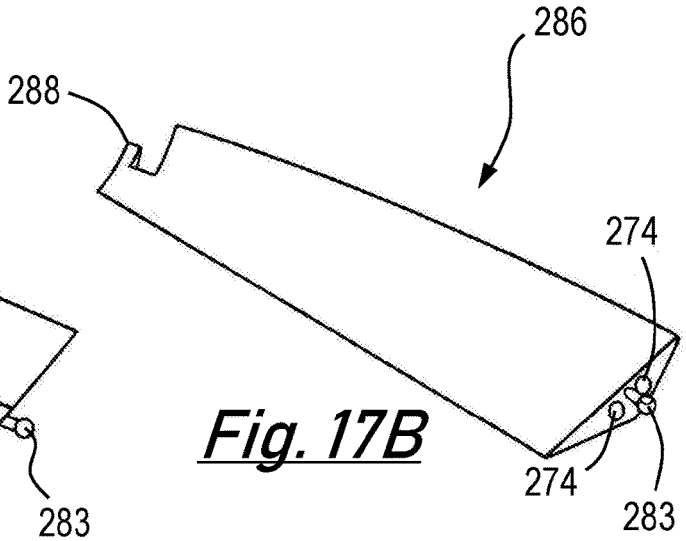
Figure 18A:
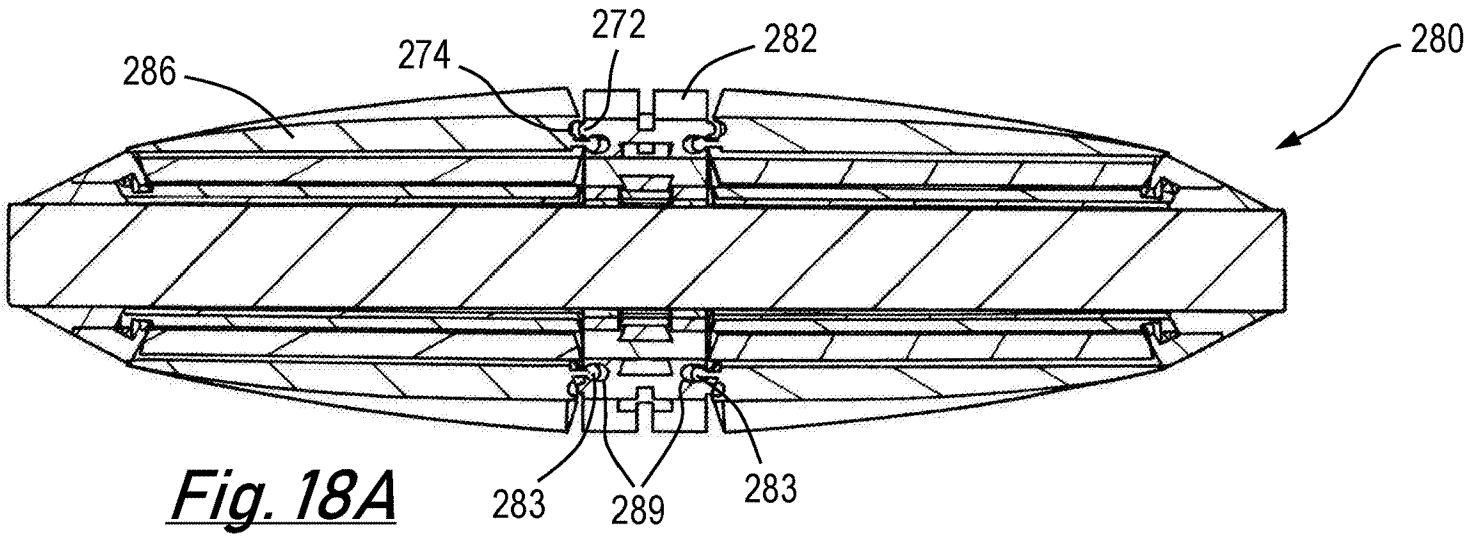
FIGS. 18A and 18B are longitudinal sectional views of an apparatus incorporating the ring element and structural element of FIGS. 16A to 17B respectively in collapsed and expanded conditions.
Figure 18B:
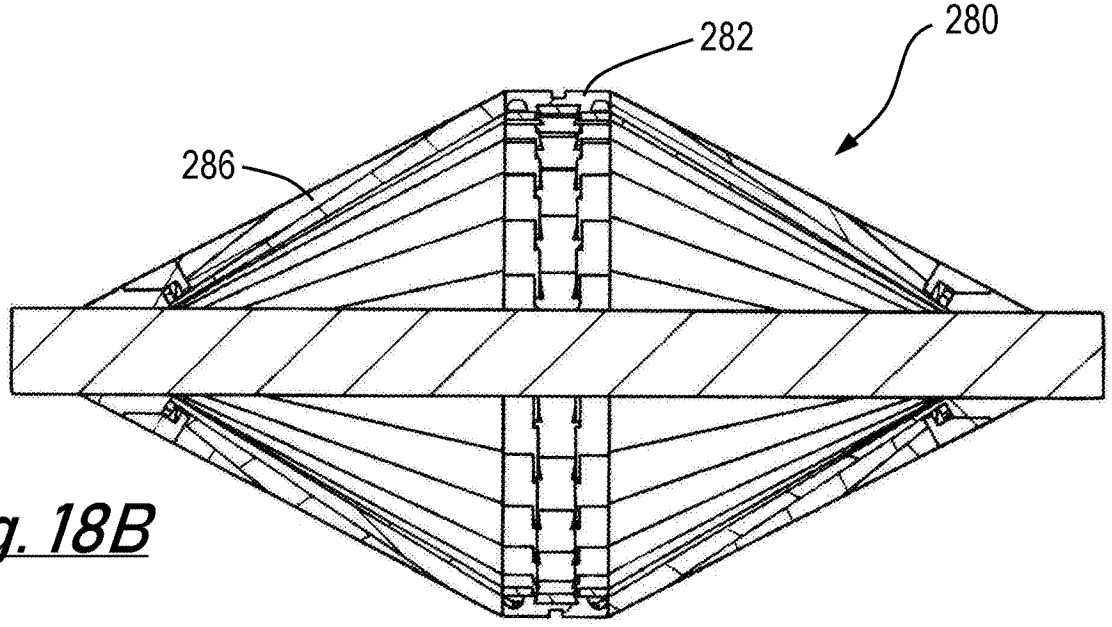

A variation to the apparatus 80 will now be described with reference FIGS. 16A to 18B. FIGS. 18A and 18B are longitudinal sectional views of an apparatus 280, which is similar to the apparatus 80 and which will be understood from FIGS. 10 to 15 and the accompanying description. FIGS. 16A to 16C are various views of a ring element 282 of the apparatus 280, and FIGS. 17A and 17B are isometric views of a structural element 286. The basic geometry of the ring element 282 and structural element 286 is the same as the geometry of the elements 82 and 86 as previously described. As with the apparatus 80, a hook 288 is provided for engaging with an undercut in the retaining ring. However, the elements of this embodiment differ in the configuration of their connection to one another. Instead of the spherical ball joint and socket provided in components of the apparatus 80, the apparatus 280 has a knuckle joint 283 provided on the structural element 286, and a corresponding socket 289 on the ring element 282. The socket 289 comprises an opening on the lower contact surface for receiving the knuckle 283, and a U-shaped slot in the side wall which enables the elements to be assembled while retaining the knuckle, and allows a tension to be pulled between the structural element and the retaining ring (or vice versa).

Corresponding side walls of the ring element 282 and the structural element 286 are also provided with a cooperating arrangement of knurls 272 and sockets 274. The knurls 272 self-locate in the sockets 274 when the apparatus is in its expanded condition, shown in FIG. 18B and provide additional support to the structure. In this embodiment, two knurls are provided on each side wall of each ring element, with corresponding sockets provided on the contacting side wall of the structural element, but it will be appreciated that in alternative embodiments the position may be reversed, and/or other configurations of locating formations may be provided.

Figure 19A:
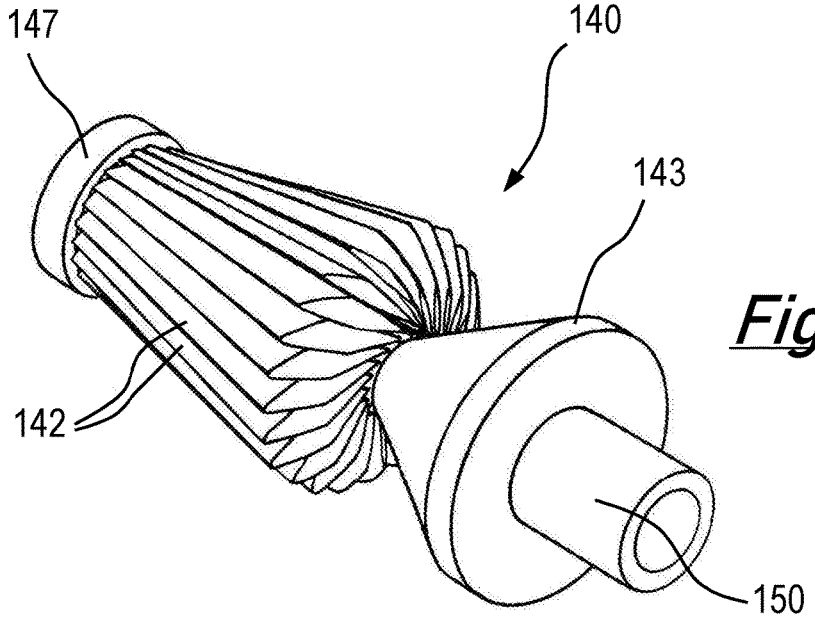
FIGS. 19A to 19C are respectively isometric, longitudinal sectional and end views of an apparatus according to an alternative embodiment of the invention in a collapsed condition.
Figure 19C:
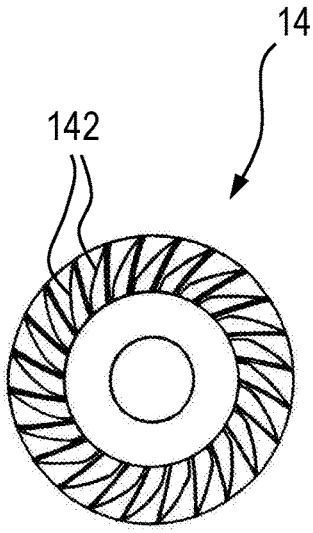
Figure 19B:
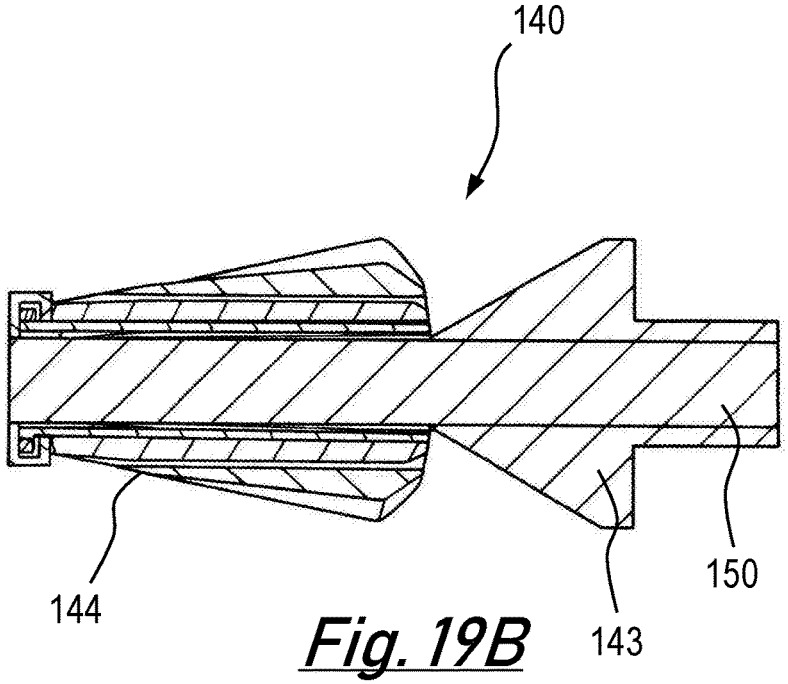
Figure 20A:
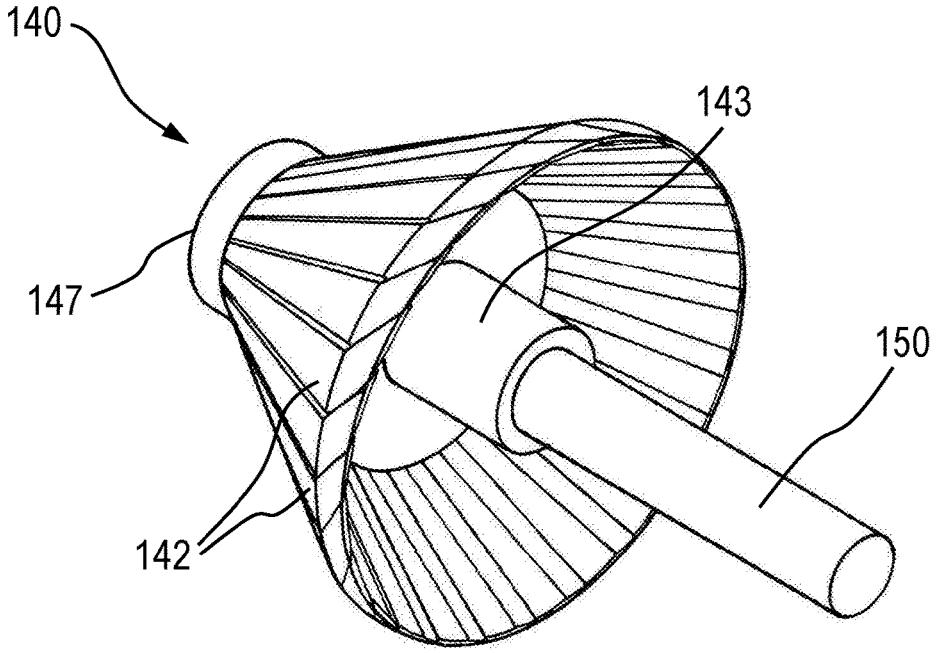
FIGS. 20A to 20C are respectively isometric, longitudinal sectional and end views of the apparatus of FIGS. 19A to 19C in an expanded condition.
Figure 20C:
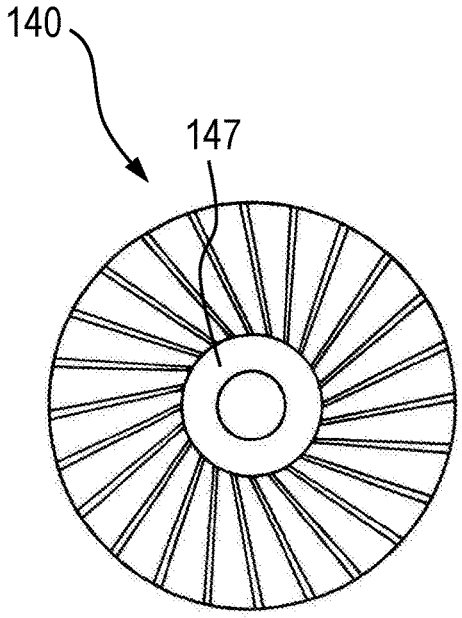
Figure 20B:
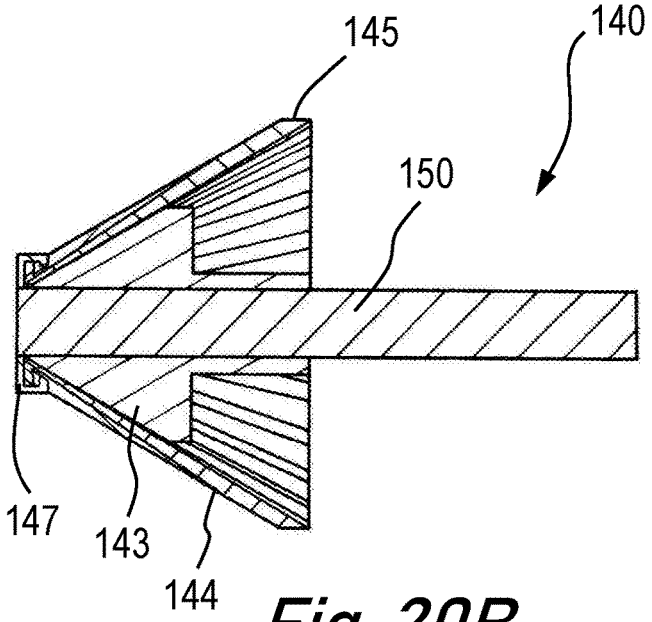

Although the foregoing embodiments include combinations of cylindrical ring structures and conical support assemblies, the principles of the invention can also be applied to alternative configurations, including expanding cone structures without connection to cylindrical rings. An example embodiment is described with reference to FIGS. 19A to 20D. FIGS. 19A to 19C are respectively isometric, longitudinal sectional and end views of an apparatus, generally depicted at 140, in a collapsed condition. FIGS. 20A to 20C are corresponding views of the apparatus 140 in an expanded condition. The apparatus 140 comprises an expansion assembly 141 formed from a plurality of elements, including a set of ring elements 142 assembled together to form conical ring structure 154. The elements 142 are assembled on a mandrel 150, with first ends of the elements connected to a retaining ring 147. Second ends of the elements 142 are adjacent an actuating wedge cone 143.

The ring elements 142 are similar to the cone segments 86, and their form and function will be understood from FIGS. 10A to 11D and the accompanying description. The shape of the ring elements 142 is created by the principles described with reference to FIGS. 14A to 15C. The cone segments comprise an outer surface, an upper planar contact surface, and a lower planar contact surface. The contact surfaces are mutually supportive when assembled to form the ring structure. In a first, collapsed condition, the apparatus has a first outer diameter, which is defined by the outer edges of the second ends of the ring elements 142. The shape of the assembly in its collapsed condition is substantially conical.

In use, the apparatus is actuated to be radially expanded to a second diameter by an axial actuation force, which acts on one or both of the retaining ring 147 or the wedge 143 to move one or both with respect to the mandrel 150. The force causes the wedge member 143 to move axially with respect to the elements, and transfer a component of the axial force onto inner surfaces of the elements. The angle of the wedge transfers a radial force component to the elements 142, which causes them to slide with respect to one another along their respective contact surfaces.

The movement of the expanding elements is tangential to a circle defined around the longitudinal axis of the apparatus. The contact surfaces of the elements mutually support one another before, during, and after expansion. The radial position of the elements increases on continued application of the axial actuation force until the elements are located at a desired outer radial position. This radial position may be defined by a controlled and limited axial displacement of the wedge member, or alternatively can be determined by an inner surface of a bore or tubular in which the apparatus is disposed.

FIGS. 20A to 20C show the apparatus in its expanded condition. At an optimal expansion condition, shown in FIGS. 20B and 20C, the outer surfaces of the individual elements combine to form a complete conical surface with no gaps in between the individual elements. At the second end of the elements 142, a cylindrical surface 145 is formed at the optimal expanded condition. The outer surfaces of the individual elements combine to form a complete circle with no gaps in between the individual elements. The outer surface of the expansion apparatus can be optimised for a specific diameter, to form a perfectly smooth cone and round expanded ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of the described arrangement that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. This enables use of the apparatus in close axial proximity to other functional elements.

Figure 21A:
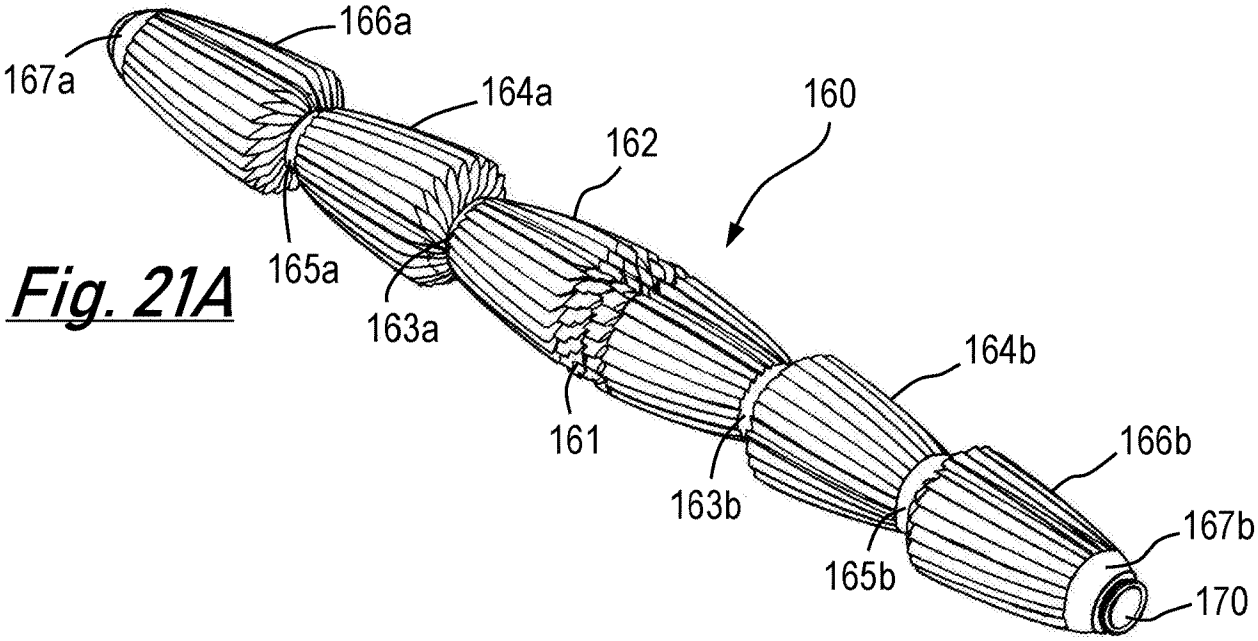
FIGS. 21A to 21C are respectively isometric, longitudinal sectional and cross sectional views of an apparatus according to an alternative embodiment of the invention in a collapsed condition.
Figure 21B:
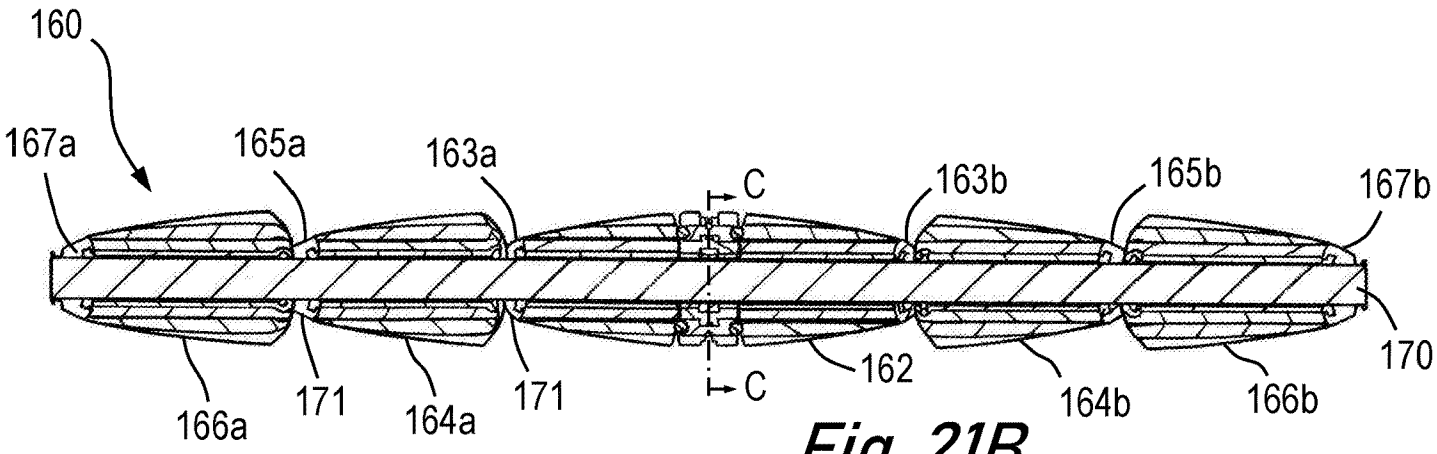
Figure 21C:
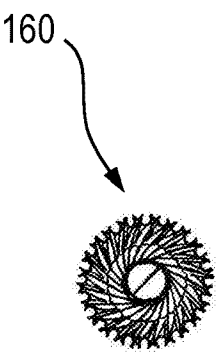
Figure 22A:
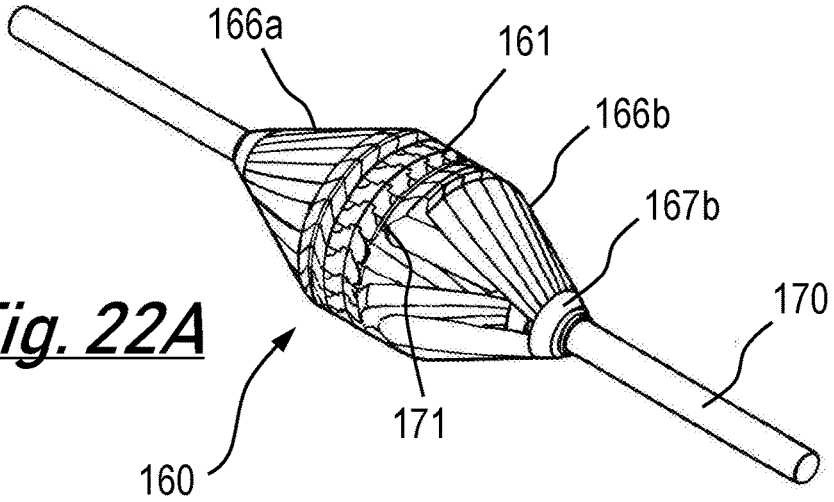
FIGS. 22A and 22B are respectively partially cut away isometric and longitudinal sectional views of the apparatus of FIGS. 21A to 21C in an expanded condition.
Figure 22B:
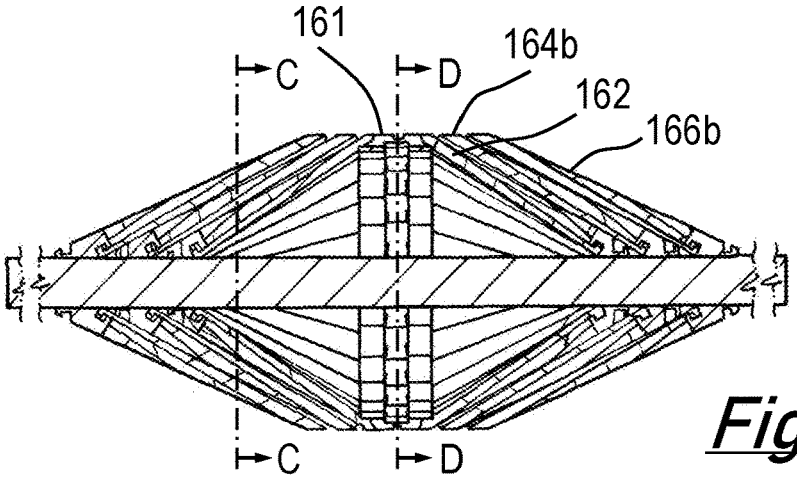
Figure 22C:
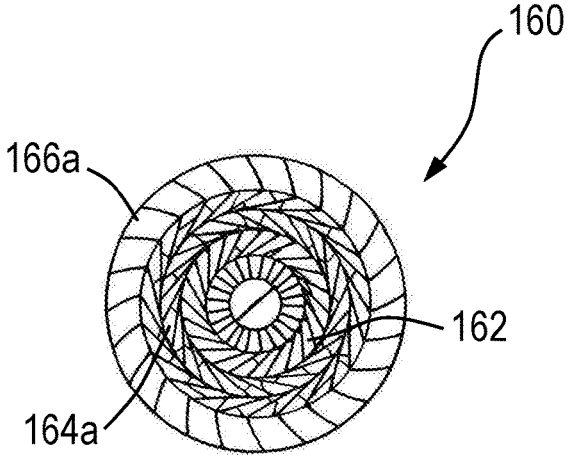
FIGS. 22C and 22D are respectively cross sectional views of the apparatus of FIGS. 22A and 22B through lines C-C and D-D.
Figure 22D:
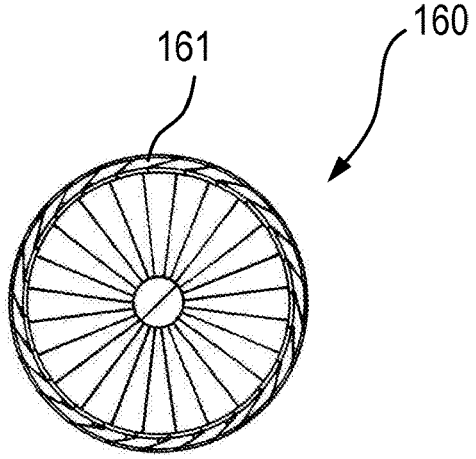
Figure 23A:
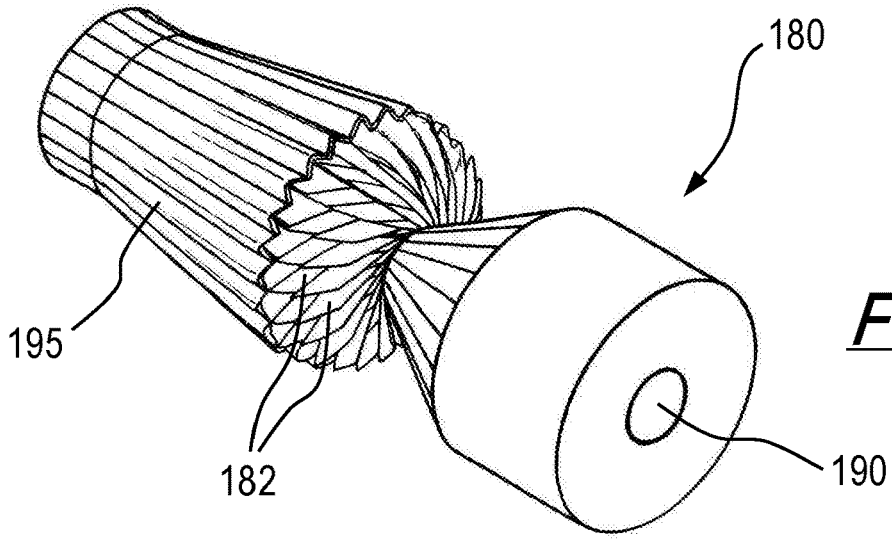
FIGS. 23A to 23C are respectively isometric, longitudinal sectional and end views of a seal apparatus according to an alternative embodiment of the invention in a collapsed condition.
Figure 23B:
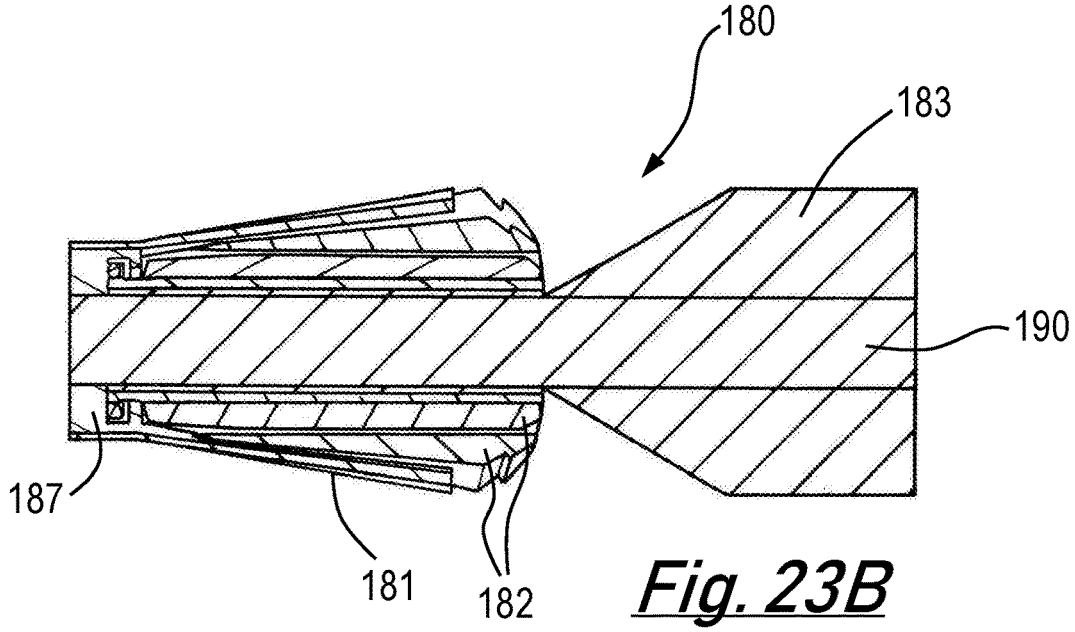
Figure 23C:
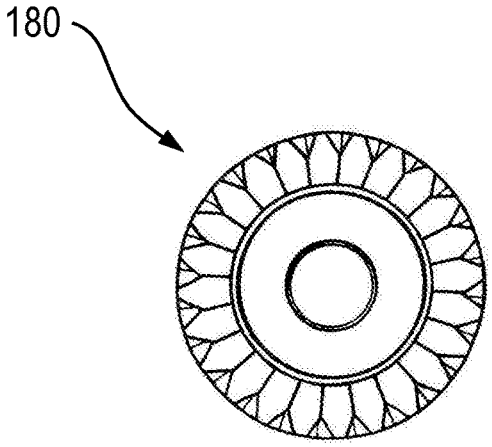
Figure 24A:
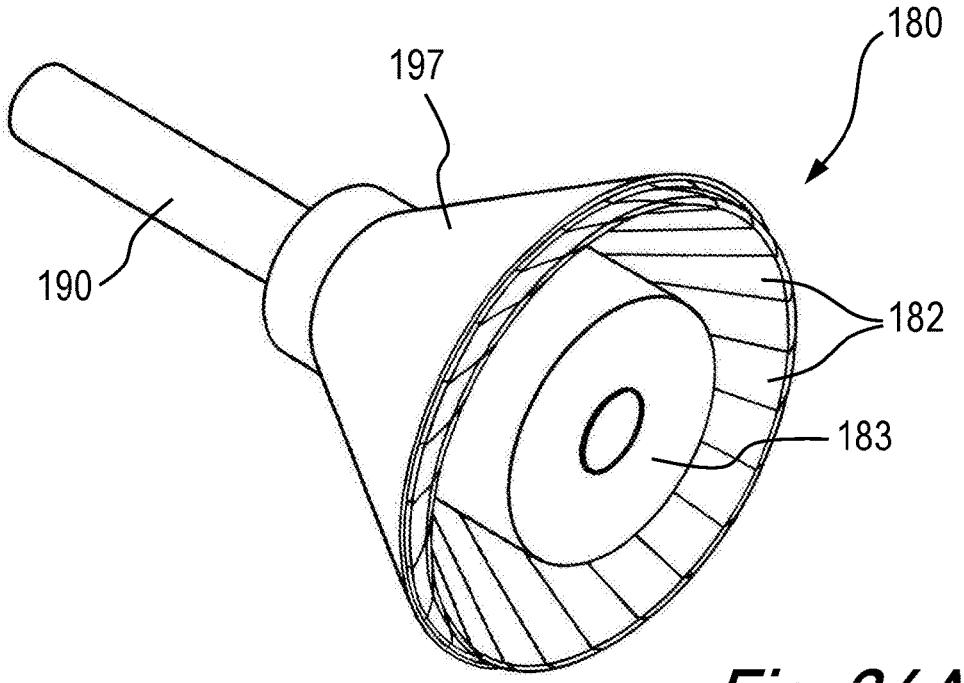
FIGS. 24A and 24C are respectively isometric, longitudinal sectional and end views of the apparatus of FIGS. 22A to 22C in an expanded condition.
Figure 24B:
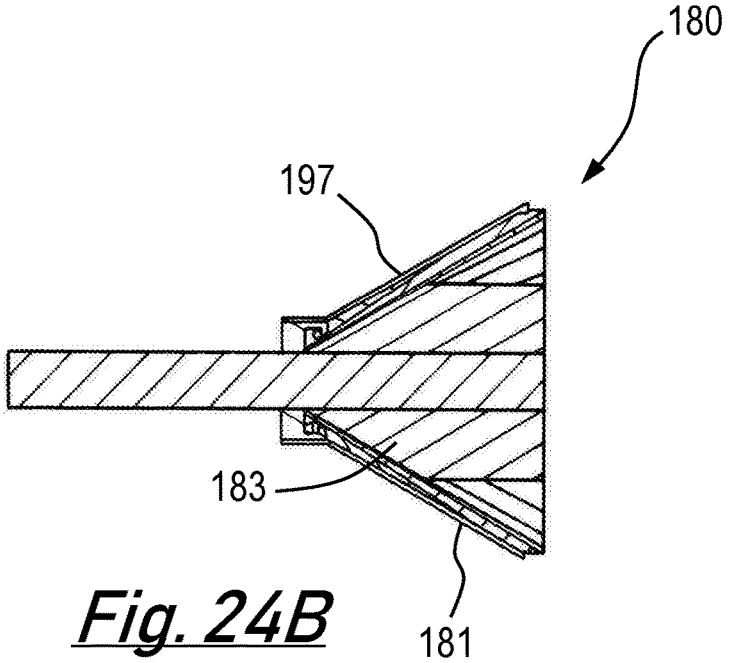
Figure 24C:
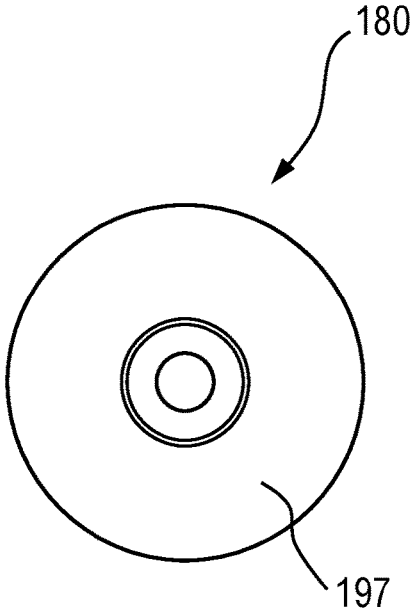

The apparatus 140 may be used in conjunction with the apparatus of other embodiments in order to provide an assembly of expanding apparatus. An example embodiment is described with reference to FIGS. 21A to 22D. FIGS. 21A to 21C are respectively isometric, longitudinal sectional and cross sectional views of an apparatus, generally depicted at 160, in a collapsed condition. FIGS. 22A and 22B are respectively partially cut away isometric and longitudinal sectional views of the apparatus 160 in an expanded condition. FIGS. 22C and 22D are respectively cross sectional views of the apparatus of FIGS. 22A and 22B through lines C-C and D-D of FIG. 22B.

The apparatus 160 comprises a mandrel 170 supporting a centrally disposed expanding apparatus 162, which is of the same form of the apparatus 80, with the same functionality and operation. Either side of apparatus 162 are expanding apparatus 164*a*, 164*b* comprising cone structures of similar construction as the apparatus 140, with the same functionality and operation. Axially outside of the apparatus 164*a*, 164*b* are additional expanding apparatus 166*a*, 166*b*, which comprise cone structures of similar construction as the apparatus 140, and have the same functionality and operation.

In use, the apparatus 160 is actuated to be radially expanded to a second diameter by an axial actuation force, which acts on one or both of the retaining rings 167*a*, 167*b* to move one or both with respect to the mandrel 170. Relative movement of the outer retaining rings causes the expanding apparatus to expand to their expanded conditions, driven by the conical wedge surfaces of the respective retaining rings 163*a*, 163*b*, 165*a* and 165*b*.

The expanded condition of the apparatus 160 is shown in FIGS. 22A to 22D. As described above with reference to FIGS. 10 and 11, the apparatus 162 expands to a form which defines first and second hollow conical support structures at first and second flanks of the apparatus. The internal angles of the hollow cones formed by expanding apparatus 164*a* and 164*b* correspond to the external cone angles of the apparatus 162, and the apparatus 164*a* and 164*b* are brought into abutment with the outer flanks of the apparatus 162 to create a nested, layered support structure. Similarly, the internal angles of the hollow cones formed by expanding apparatus 166*a* and 166*b* correspond to the external cone angles of the apparatus 164*a* and 164*b*, and the apparatus 166*a* and 166*b* are brought into abutment with the outer flanks defined by apparatus 164*a* and 164*b*. The combined apparatus, as most clearly shown in FIG. 22B, provides additional support for the cylindrical ring structure 161 of the apparatus 162 due to the increase in effective wall thickness created by the abutment of conical support structures in a nested arrangement. Each conical surface is substantially or completely smooth, and therefore the contact between conical support structures over the majority of the surfaces to optimise mechanical support.

In this embodiment, the direction in which the cone segments are layered differs between adjacent apparatus; the layering of cone segments in apparatus 164*a*, 164*b* is reversed compared to the direction of layering in apparatus 162, 166*a* and 166*b*. This results in a cross-ply effect between support layers in the expanded condition, most clearly shown in FIG. 22A, enhancing mechanical support and load bearing through the apparatus, and increasing the convolution of any path between segments of adjacent support layers.

Retraction of the apparatus to a collapsed condition is performed by releasing or reversing the axial force on the outermost retaining rings 167*a*, 167*b*. This is facilitated by lips 171 provided on the inner surface of the cone segments, most clearly shown in FIGS. 21B and 22A. When the expanding cone is in a collapsed condition, the lips 171 of its cone segments engage with an external rim on the retaining ring of an adjacent expanding cone. When the outermost pair of expanding cones 166*a*, 166*b* is collapsed under tension, the lips engage the rim of the retaining rings 165*a*, 165*b* to impart tension to the retaining rings and retract the expanding cones 164*a*, 164*b*. Similarly, the when the expanding cones 164*a*, 164*b* are collapsed under tension, the lips 171 engage the rim of the retaining rings 163*a*, 163*b* to impart tension to the retaining rings and retract the expanding apparatus 162.

Although two pairs of expanding cones are provided to support the apparatus 162 in the embodiment of FIGS. 21 to 22, in alternative embodiments fewer or greater numbers of expanding cones may be used, depending on the application. In some applications, support may be provided by a single expanding cone brought into abutment with just one of the flanks of the apparatus 162. Alternatively, multiple expanding cones may be used in a nested configuration to support just one of the flanks of the apparatus 162. Alternatively, unequal numbers of expanding cones may be used to support opposing flanks of the apparatus 162.

Within the scope of the invention, the expanding apparatus used in nested configurations as described with reference to FIGS. 21 and 22 may have different physical properties including but not limited to configuration, size, wall thickness, conical angle, and/or material selection, depending on application. For example, in a variation to the embodiment described with reference to FIGS. 21 and 22, the cone segments of apparatus 164*a* and 164*b* differ from the cone segments of the apparatus 162, 166*a* and 166*b* to provide an improved sealing effect. The cone segments of the apparatus 164*a*, 164*b* are formed from metal which is coated with a compliant polymeric material, such as a silicone polymer coating. All surfaces of the elements are coated, and the mutually supportive arrangement of the cone segments within the apparatus 164*a*, 164*b*, combined with the support from the adjacent apparatus 162, 166*a* and 166*b*, keeps them in compression in their operating condition. This enables the combined apparatus to function effectively as a flow barrier, and in some applications, the barrier created is sufficient to seal against differential pressures to create a fluid tight seal.

In variations to the described embodiment, the material selected for the cone segments itself is a compliant or elastomeric material such as an elastomer, polymer or rubber rather than a coated metallic or other hard material. Alternatively, the segments may comprise a skeleton or internal structure formed from a metallic or other hard material, coated or encased in a compliant or elastomeric material such as an elastomer, polymer or rubber an elastomer, polymer or rubber. The cone segments of all, some or one of the expanding apparatus may be formed from these alternative materials, or different materials may be used for different expanding apparatus. An individual expanding apparatus of the invention may be configured to provide sealing functionality, and may therefore similarly be fully or partially formed from compliant or elastomeric materials.

Referring now to FIGS. 23A to 24C, there is shown an expanding and collapsing apparatus in accordance with an alternative embodiment of the invention, configured as a seal for a fluid conduit or borehole. The apparatus, generally depicted at 180, comprises an expansion assembly 181 formed from a plurality of elements, including a set of ring elements 182 assembled together to form conical ring structure 184. The elements 182 are assembled on a mandrel 190, with first ends of the elements connected to a retaining ring 187. Second ends of the elements 182 are adjacent an actuating wedge cone 183. The ring elements 182 are similar to the cone segments 86 and 142, and their form and function will be understood from FIGS. 10A to 11D, 19A to 20B, and the accompanying description. The shape of the ring elements 182 is created by the principles described with reference to FIGS. 14A to 15C. The cone segments comprise an outer surface, an upper planar contact surface, and a lower planar contact surface. The contact surfaces are mutually supportive when assembled to form the ring structure. In a first, collapsed condition, the apparatus has a first outer diameter, which is defined by the outer edges of the second ends of the ring elements 182. The shape of the assembly in its collapsed condition is substantially conical.

The apparatus 180 differs from the apparatus 140 in that it is provided with a pleated layer 195 of compliant sealing material. The layer 195 surrounds the retaining ring 187 and the expanding assembly 181 over the majority of its length, and is pleated to follow the profiled surface of upstanding edges and grooves defined by the collapsed assembly 181. The apparatus is actuated by an axial actuation force, which acts on one or both of the retaining ring 187 or the wedge 183. As the apparatus is expanded to the expanded condition shown in FIGS. 24A to 24C, the layer 195 is unfolded to form a compliant conical sheath 197 around the expanded conical structure.

The apparatus 180 is just one example of how the invention may be applied to a fluid barrier or sealing apparatus, and other fluid barrier or sealing configurations are within the scope of the invention. For example, the apparatus may be configured to operate in conjunction with a sealing element, for example an elastomeric body or an inflatable bladder, disposed beneath a hollow conical structure formed by the expanded cone segments.

The invention may be used to provide an anti-extrusion ring or back-up ring for a wide range of expanding, radially expanding or swelling elements. For example, the apparatus may be used as an anti-extrusion or back-up ring for compressible, inflatable and/or swellable packer systems. Alternatively, or in addition, the expansion apparatus may provide support or back-up for any suitable flow barrier or seal element in the fluid conduit. This may function to improve the integrity of the fluid barrier or seal, and/or enable a reduction in the axial length of the seal element or flow barrier without compromising its functionality. A particular advantage is that equipment incorporating the expansion apparatus of the present invention can be rated to a higher maximum working pressure.

In the foregoing embodiments, where the expanding and collapsing apparatus is used to create a seal, the seal is typically disposed between two expanding ring structures. In alternative embodiments (not illustrated), an expanding ring structure can be used to provide a seal, or at least a restrictive flow barrier directly. To facilitate this, the elements which are assembled together to create the ring structures may be formed from metal or a metal alloy which is coated with a polymeric, elastomeric or rubber material. An example of such a material is a silicone polymer coating. All surfaces of the elements may be coated, for example by a dipping or spraying process, and the mutually supportive arrangement of the elements keeps them in compression in their operating condition. This enables the ring structures themselves to function as flow barriers, and in some applications, the barrier created is sufficient to seal against differential pressures to create a fluid tight seal.

A further application of the invention is to a fluid conduit patch tool and apparatus. A typical patching application requires the placement and setting of a tubular section over a damaged part of a fluid conduit (such as a wellbore casing). A patch tool comprises a tubular and a pair of setting mechanisms at axially separated positions on the outside of the conduit for securing the tubular to the inside of the fluid conduit. It is desirable for the setting mechanisms to provide an effective flow barrier, but existing patch systems are often deficient in providing a fluid-tight seal with the inner surface of the fluid conduit.

A patch tool incorporating the expanding apparatus of the invention has the advantage of high expansion for a slim outer diameter profile, which enables the tool to be run through a restriction in the fluid conduit, to patch a damaged part of the conduit which has a larger inner diameter than the restriction. For example, the patching tool could be run through a part of the fluid conduit that has already been patched.

In a further alternative embodiment of the invention (not illustrated) the characteristics of the expanding/collapsing apparatus are exploited to provide a substrate which supports a seal or another deformable element. As described herein, the expanded ring structures of the invention provide a smooth circular cylindrical surface and/or a smooth conical surface at their optimum expanded conditions. This facilitates their application as a functional endo-skeleton for a surrounding sheath. In one example application, a deformable elastomeric sheath is provided over an expanding ring structure. When in its collapsed condition, the sheath is supported by the collapsed ring structures. The ring structures are deployed in the manner described with reference to FIGS. 10 and 11, against the retaining force of the circumferential spring element and any additional retaining force provided by the sheath, and the sheath is deformed to expand with the ring structure into contact with the surrounding surface. The sheath is sandwiched between the smooth outer surface of the ring structure and the surrounding surface to create a seal.

It will be appreciated that the apparatus could be used as an endo-skeleton to provide structural support for components other than deformable sheaths, including tubulars, expanding sleeves, locking formations and other components in fluid conduits or wellbores.

The expansion apparatus of the invention may be applied to a high expansion packer or plug, and in particular a high expansion retrievable bridge plug. The ring structure may be arranged to provide a high-expansion anti-extrusion ring for a seal element of a plug. Alternatively, or in addition, elements of ring structures of the apparatus may be provided with engaging means to provide anchoring forces which resist movement in upward and/or downward directions. The elements of the rings structure may therefore function as slips, and may in some cases function as an integrated slip and anti-extrusion ring. Advantages over previously proposed plugs include the provision of a highly effective anti-extrusion ring; providing an integrated slip and anti-extrusion assembly, which reduces the axial length of the tool; providing slips with engaging surfaces which extend around the entire circumference of the tool to create an enlarged anchoring surface, which enables a reduction in the axial length of the slips for the same anchoring force; the ability of slips of a ring structure of one particular size to function effectively over a wider range of tubular inner diameters and tubing weights/wall thicknesses.

Alternatively, or in addition, the apparatus may be used to anchor any of a wide range of tools in a wellbore, by providing the surfaces of the element with engaging means to provide anchoring forces which resist movement in upward and/or downward directions.

Variations to embodiments of the invention include the provision of functional formations on the basic elements in various arrangements. These may include knurls and sockets for location and support, hooks, balls and sockets or knuckles and sockets for axial connection, and/or pegs and recesses to prevent relative rotation of the elements with respect to one another and/or with respect to the underlying structure of the apparatus.

The invention also has benefits in creating a seal and/or filling an annular space, and an additional example application is to downhole locking tools. A typical locking tool uses one or more radially expanding components deployed on a running tool. The radially expanding components engage with a pre-formed locking profile at a known location in the wellbore completion. A typical locking profile and locking mechanism includes a recess for mechanical engagement by the radially expanding components of the locking tool. A seal bore is typically provided in the profile, and a seal on the locking tool is designed to seal against the seal bore.

One advantage of the application of the invention to locking mechanism is that the locking mechanism may be provided with an integrated seal element between two expanding ring structures, and does not require a seal assembly at an axially separated point. This enables a reduction in the length of the tool. The integrated seal is surrounded at its upper and lower edges by the surfaces of the ring structures, which avoid extrusion of the seal.

In addition, each of the ring structures provides a smooth, unbroken circumferential surface which may engage a locking recess, providing upper and lower annular surfaces in a plane perpendicular to the longitudinal axis of the bore. This annular surface may be smooth and unbroken around the circumference of the ring structures, and therefore the lock is in full abutment with upper and lower shoulders defined in the locking profile. This is in contrast with conventional locking mechanisms which may only have contact with a locking profile at a number of discrete, circumferentially-separated locations around the device. The increased surface contact can support larger axial forces being directed through the lock. Alternatively, an equivalent axial support can be provided in a lock which has reduced size and/or mass.

Another advantage of this embodiment of the invention is that a seal bore (i.e. the part of the completion with which the elastomer creates a seal) can be recessed in the locking profile. The benefit of such configuration is that the seal bore is protected from the passage of tools and equipment through the locking profile. This avoids impact with the seal bore which would tend to damage the seal bore, reducing the likelihood of reliably creating a successful seal.

Similar benefits may be delivered in latching arrangements used in connectors, such as so called "quick connect" mechanisms used for latched connection of tubular components. A significant advantage of the invention in connection system applications is that the expansion apparatus forms a solid and smooth ring in an expanded latched position. An arrangement of radially split elements would, when expanded, form a ring with spaces between elements around their sides. In contrast, the provision of a continuous engagement surface on the expansion ring which provides full annular contact with the recess results in a latch capable of supporting larger axial forces. In addition, the by minimising or eliminating gaps between elements, the device is less prone to ingress of foreign matter which could impede the collapsing action of the mechanism. These principles may also be applied to subsea connectors such as tie-back connectors, with optional hydraulic actuation of their release mechanism.

Additional applications of the principles of the invention include variable diameter tools, examples of which include variable diameter drift tools and variable diameter centralising tools. The position of a wedge member and a cooperating surface may be adjusted continuously or to a number of discrete positions, to provide a continuously variable diameter, or a number of discrete diameters.

In one aspect, the invention provides an expanding and collapsing apparatus and methods of use. The apparatus comprises a plurality of elements assembled together to form a ring structure around a longitudinal axis. The ring structure is operable to be moved between an expanded condition and a collapsed condition by movement of the plurality of elements on actuation by an axial force. At least one set of structural elements each having a first end and a second end are operable to move between the expanded condition and the collapsed condition by movement of the first end in an axial direction, and by movement of the second end in at least a radial dimension. The plurality of elements comprises at least one set of elements operable to be moved between the expanded and collapsed conditions by sliding with respect to one another in a direction tangential to a circle concentric with the ring structure.

In another aspect, the expanding and collapsing ring comprises a plurality of elements assembled together to form a ring structure oriented in a plane around a longitudinal axis. The plurality of elements comprises at least one set of structural elements extending longitudinally on the apparatus and operable to slide with respect to one another, wherein the sliding movement in a selected plane perpendicular to the longitudinal axis is tangential to a circle in the selected plane and concentric with the longitudinal axis. Applications of the invention include oilfield devices, including anti-extrusion rings, plugs, packers, locks, patching tools, connection systems, and variable diameter tools run in a wellbore.

The invention in its various forms benefits from the novel structure and mechanism of the apparatus. The invention also enables high expansion applications.

In addition, at an optimal expansion condition the outer surfaces of the individual elements combine to form a complete circle with no gaps in between the individual elements, and therefore the apparatus can be optimised for a specific diameter, to form a perfectly round expanded ring (within manufacturing tolerances) with no extrusion gaps on the inner or outer surfaces of the ring structure. The design of the expansion apparatus also has the benefit that a degree of under expansion or over expansion (for example, to a slightly different radial position) does not introduce significantly large gaps.

It is a feature of an aspect of the invention that the elements are mutually supported before, throughout, and after the expansion, and do not create gaps between the individual elements during expansion or at the fully expanded position. In addition, the arrangement of elements in a circumferential ring facilitates the provision of smooth side faces or flanks on the expanded ring structure. This enables use of the apparatus in close axial proximity to other functional elements, and/or as ramps or surfaces for deployment of other expanding structures.

In addition, each of the ring structures provides a smooth, unbroken circumferential surface which may be used in engagement or anchoring applications, including in plugs, locks, and connectors. This may provide an increased anchoring force, or full abutment with upper and lower shoulders defined in a locking or latching profile, enabling tools or equipment be rated to a higher maximum working pressure.

Various modifications to the above-described embodiments may be made within the scope of the invention, and the invention extends to combinations of features other than those expressly claimed herein. In particular, the different embodiments described herein may be used in combination, and the features of a particular embodiment may be used in applications other than those specifically described in relation to that embodiment.

The invention claimed is:

1. An expanding and collapsing apparatus comprising:

a plurality of elements assembled together to form a ring structure around a longitudinal axis, wherein the ring structure is operable to be moved between an expanded condition and a collapsed condition by movement of the plurality of elements;

wherein the plurality of elements comprises at least one set of structural elements each having a first end and a second end, wherein the structural elements are operable to move between the expanded condition and the collapsed condition by movement of the first end in an axial direction, and by movement of the second end in at least a radial direction;

wherein the plurality of elements comprises at least one set of ring elements operable to be moved between the expanded and collapsed conditions by sliding with respect to one another in a direction tangential to a circle concentric with the ring structure;

wherein the ring elements comprise first and second contact surfaces oriented on first and second planes;

wherein the first and second planes intersect one another on a radial plane P which bisects the first and second planes between the centre of the ring and tangent points of an inner surface of the ring structure.

2. The apparatus according to claim 1, wherein the set of structural elements together forms a substantially conical structure in the expanded condition.

3. The apparatus according to claim 1, wherein the set of structural elements together forms a substantially conical structure in the collapsed condition and/or a partially expanded condition.

4. The apparatus according to claim 1, wherein each of the ring elements describes an angle (θ1) at an outer surface of the ring structure in the range of 10 degrees to 20 degrees.

5. The apparatus according to claim 1, wherein the first and second planes are tangential to an inner surface of the ring structure formed by the ring elements at first and second lines.

6. The apparatus according to claim 1, wherein the structural elements comprise structural ring elements, operable to be moved between the expanded and collapsed conditions by sliding with respect to one another in a direction tangential to a circle concentric with the ring structure.

7. The apparatus according to claim 6, wherein the structural ring elements extend longitudinally on the apparatus, and are operable to slide with respect to one another, with the sliding movement in a selected plane perpendicular to the longitudinal axis being tangential to a circle in the selected plane and concentric with the longitudinal axis.

8. The apparatus according to claim 1, wherein each structural element is pivotally connected to a ring element at its second end.

9. The apparatus according to claim 1, comprising a retaining ring, wherein the structural element is connected to the retaining ring at its first end, by a connection which enables the transfer of a tensile force between the structural element and the retaining ring.

10. The apparatus according to claim 1, wherein the set of structural elements together forms a substantially conical structure having a conical surface comprising openings in the conical surface between the structural elements.

11. The apparatus according to claim 1, wherein the structural elements are struts or spokes, and the apparatus comprises a plurality of struts or spokes circumferentially distributed about the longitudinal axis.

12. The apparatus according to claim 1, comprising a formation configured to impart a radial expanding or collapsing force component to the structural elements of the ring structure from an axial actuation force.

13. The apparatus according to claim 12, wherein the formation comprises a wedge or wedge profile.

14. The apparatus according to claim 1, wherein the structural elements are segments of a cone, the segments of the cone comprise first and second contact surfaces oriented on first and second planes, and the first and second planes are tangential to an inner surface of the ring structure formed by the segments at first and second lines.

15. An expanding and collapsing apparatus comprising:

a plurality of identical ring elements assembled together to form a ring structure around a longitudinal axis; and at least one set of structural elements extending longitudinally on the apparatus and operable to slide with respect to one another, wherein the sliding movement in a selected plane perpendicular to the longitudinal axis is tangential to a circle in the selected plane and concentric with the longitudinal axis;

wherein the ring structure is operable to be moved between an expanded condition and a collapsed condition by movement of the plurality of identical ring elements, each identical element being in contact with an adjacent identical element in the expanded and collapsed conditions.

16. The apparatus according to claim 15, wherein the structural elements extend longitudinally on the apparatus and are operable to slide with respect to one another, with the sliding movement in any selected plane along the length of the structural element and perpendicular to the longitudinal axis being tangential to a circle in the selected plane and concentric with the longitudinal axis.

17. The apparatus according to claim 15, wherein the structural elements each have a first end and a second end, wherein the structural elements are operable to move between the expanded condition and the collapsed condition by movement of the first end in an axial direction, and by movement of the second end in at least a radial direction;

and wherein the plurality of identical ring elements is operable to be moved between the expanded and collapsed conditions by sliding with respect to one another in a direction tangential to a circle concentric with the ring structure.

18. The apparatus according to claim 15, wherein each structural element of the at least one set of structural elements is in the form of a cone segment such that a plurality of structural elements together form a substantially conical structure having a conical surface.

19. A method of expanding or collapsing an expanding and collapsing apparatus, the method comprising:

providing a plurality of elements assembled together to form a ring structure around a longitudinal axis, wherein the plurality of elements comprises: at least one set of structural elements each having a first end and a second end and at least one set of ring elements each having first and second contact surfaces oriented on first and second planes, wherein the first and second planes intersect one another on a radial plane P which bisects the first and second planes between the centre of the ring and tangent points of an inner surface of the ring structure;

moving the first ends of the structural elements in an axial direction, and moving the second ends of the structural elements in at least a radial direction;

and moving at least one set of ring elements of the plurality of elements between the expanded and collapsed conditions by sliding them with respect to one another in a direction tangential to a circle concentric with the ring structure.

* * * * *